US009539456B2

(12) United States Patent
Monzyk et al.

(10) Patent No.: US 9,539,456 B2
(45) Date of Patent: Jan. 10, 2017

(54) FORMULATIONS AND METHODS TO REDUCE HEXAVALENT CHROME CONTAMINATION

(75) Inventors: Bruce F. Monzyk, Town Creek, AL (US); Paul J. Usinowicz, Powell, OH (US); Derik R. Heiss, Plain City, OH (US); Vinay V. Gadkari, Powell, OH (US); John T. Stropki, Westerville, OH (US)

(73) Assignee: Battelle Memorial Institute, Columbus, OH (US)

( * ) Notice: Subject to any disclaimer, the term of this patent is extended or adjusted under 35 U.S.C. 154(b) by 596 days.

(21) Appl. No.: 14/008,071

(22) PCT Filed: Mar. 30, 2012

(86) PCT No.: PCT/US2012/031398

§ 371 (c)(1), (2), (4) Date: Sep. 27, 2013

(87) PCT Pub. No.: WO2012/135594

PCT Pub. Date: Oct. 4, 2012

(65) Prior Publication Data

US 2014/0023555 A1 Jan. 23, 2014

Related U.S. Application Data

(60) Provisional application No. 61/469,123, filed on Mar. 30, 2011.

(51) Int. Cl.

| | |
|---|---|
| ***A62D 3/36*** | (2007.01) |
| ***A62D 3/37*** | (2007.01) |
| ***C23C 22/83*** | (2006.01) |
| *A62D 101/24* | (2007.01) |
| *A62D 101/43* | (2007.01) |

(52) U.S. Cl.

CPC ..... *A62D 3/37* (2013.01); *C23C 22/83* (2013.01); *A62D 2101/24* (2013.01); *A62D 2101/43* (2013.01)

(58) Field of Classification Search

CPC ..... A62D 3/36; A62D 3/37; A62D 3/38
USPC ..... 588/318, 319, 320, 300
See application file for complete search history.

(56) References Cited

U.S. PATENT DOCUMENTS 3,493,441 A * 2/1970 Hans ..... C23C 22/83 148/256
3,537,896 A * 11/1970 Gunter ..... C23C 22/83 134/13

FOREIGN PATENT DOCUMENTS

DE 34 43 928 A1 * 6/1986
WO WO 99/00159 A1 * 1/1999

* cited by examiner

*Primary Examiner* — Edward Johnson
(74) *Attorney, Agent, or Firm* — Yimei C. Hammond; Kremblas & Foster

(57) ABSTRACT

The present invention includes formulations and methods to reduce Cr(VI) contamination, in which the formulation comprises (1) a reactive reducing agent comprising at least one reducing chemical capable of reducing Cr(VI) to Cr(III); and (b) one or more solvents. Moreover, the present invention includes formulations to reduce Cr(VI) within the coating, and Cr(VI) reducing kits with at least one color reference tool for evaluating the process and/or completion of the Cr(VI) reduction.

13 Claims, 6 Drawing Sheets

FORMULATIONS AND METHODS TO REDUCE HEXAVALENT CHROME CONTAMINATION

This application claims the benefit of U.S. Provisional Application 61/469,123 filed 30 Mar. 2011. This U.S. Provisional Application is hereby incorporated by reference.

FIELD OF THE INVENTION

The invention includes formulations and methods to reduce or eliminate hexavalent chromium contamination in the environment, such as metal surface finishing, field repair of equipment, site remediation, recycling operations, painting and de-painting operations, and dust cleaning work areas.

BACKGROUND OF THE INVENTION

Chromium exists primarily in trivalent (Cr(III)) or hexavalent (chromium(VI), Cr(VI) or $Cr^{+6}$) oxidation states. Cr(VI) is a notorious environmental pollutant because it is strongly carcinogenic due to the ability of Cr(VI) ion in its water soluble form, $CrO_4^{=}$, to migrate in the biological fluids and to access sensitive living biological tissues, causing oxidative damage to these tissues. Cr(III) is reactively inert and relatively nontoxic; further, it is an essential trace nutrient in the diet of humans. All forms of hexavalent chromium are recognized by the United States National Institute of Environmental Health Sciences as a Group I known human carcinogen. Thus, hexavalent chromium is coming under increasing federal and state environmental regulations.

For metal surfaces, protective coatings containing hexavalent chromium ("chromate," "Cr(VI)," or "Cr") have been heavily used for many decades because of their excellent long term corrosion inhibition, enhanced coating adhesion, and self-sealing attributes, especially for coated and/or uncoated aluminum, steel, and zinc (galvanized) materials. During the process of applying these protective coatings, including re-finishing or stripping such coatings, the Cr(VI) materials enter the environment as dusts (airborne Cr(VI)) in places such as surface finishing shops, nondestructive inspection facilities, repair facilities and repainting areas.

To protect against airborne exposure to Cr(VI), the operators have to use paint mixing pots, paint spray guns, paint transfer hoses, air filters, rags and protective personal protection (i.e., Tyvek® suits, gloves, air-assisted face masks, and paper boots). The equipment so used becomes contaminated with the Cr(VI) dusts. These chromate containing dusts are very hazardous to human health. As such, agencies such as the U.S. Occupational Safety and Health Administration (OSHA) have strict guidelines for the levels of chromate allowed in the working environment. Current tough constraints on chromate contamination (Permissible Exposure Level or PEL is 5 μg Cr(VI)/$m^3$ per 8-hour time worked average) by OSHA result in frequent citations to these refinishing shops for chromate contaminated dust violations.

BRIEF DESCRIPTION OF THE INVENTION

A better technology is needed for detoxifying chromate (or "Cr(VI)" or "chromium(VI)") from chromate containing coatings and chromate associated application/removal materials or equipment. The present invention provides formulations and methods to reduce chromium(VI) contamination, which includes (1) a reactive reducing agent (RR agent) comprising at least one reducing chemical capable of reducing chromium(VI) to chromium(III); and (2) preferably with at least one solvent. Preferably, one or more chelating agents are added to the formulation to assist extraction and/or reduction of Cr(VI).

Possible applications for using the present invention to reduce Cr(VI) to Cr(III) include, but are not limited to, the following processes:

- the application of Cr(VI) containing chemical conversion coatings to the surfaces of various ferrous and non-ferrous substrates;
- the application and chemical stripper removal of Cr(VI) containing primers, sealants, and adhesives,
- the clean-up of Cr(VI) containing paint mixing and application equipment,
- the clean-up and disposal of Cr(VI) contaminated tape and masking materials, paint booth filters, PPE, rags, and non-used coatings, sealants and adhesives,
- wet or moisture-assisted Cr(VI) related sanding operations, and
- chemical wipes for Cr(VI) contaminated surfaces and spill containment.

Preferably, the reducing chemical includes, but is not limited to, water soluble thiol compounds, sulfites, sulfides, dithionite, sulfur dioxide, ferrous salts, hydroxylamines and the like, solvent soluble thiol compounds, oil soluble mercaptans, disulfides, thiol ethers, other similar organosulfur compounds or derivatives, ascorbic acid, ascorbate, sorbate, sorbic acid, acetic acid, propionic acid, butylated hydroxytoluene, butylated hydroxyanisole, tert-butylhydroquinone, propyl gallate, glycolic acid (or hydroxyacetic acid) and other α-hydroxy acids (AHA), formic acid, and other similar acids, or a mixture thereof.

Unlimited examples of the preferred solvent include water, toluene, acetone, ethanol, diglyme, isopropyl alcohol, methyl ethyl ketone (MEK), methyl isopropyl ketone, glycol ether, methyl isobutyl ketone (MIBK), Graf Off® cleaner, GOOP® cleaner, GO-JO® cleaner, other similar degreasers or degreasing agents, paint stripper or remover, such as dichloromethane, Perc (perchloroethylene), Trichlor (TCE, trichloroethylene), turpentine, linseed oil, propylene glycol, tripropylene glycol methyl ether, D-limonene, limonene, citrus extracts, N-methyl pyrrolidone (NMP), alkyl esters of succinic, adipic, and/or glutaric acids, aromatic hydrocarbons, dimethylformamide, dimethyl sulfone (DMSO), propylene carbonate, chloroform, carbon tetrachloride, ethyl acetate, isopropanol, skin-penetrating hand creams and ointments, or a mixture thereof.

According to some further embodiments of the present invention, the formulation includes one or more emulsifier agents, pH adjusting agents, activators, surfactants, viscosity modifiers, gelling agents, or mixtures thereof.

In some alternative embodiments, the present invention includes a method to reduce Cr(VI) contamination, which includes:

- applying to a surface of a paint coating or finishing a Cr(VI) reducing formulation, wherein the formulation comprises
  - a reactive reducing agent comprising at least one reducing chemical capable of reducing Cr(VI) to Cr(III); and
  - one or more solvents.
- allowing the formulation of step 1 to reduce Cr(VI) in the paint coating to Cr(III), resulting in a treated paint coating; and
- removing the treated paint coating.

Preferably, the formulation further comprises one or more chelating agents. More preferably, the formulation comprises one or more emulsifier agents, pH adjusting agents, activators, surfactants, viscosity modifiers, gelling agents, or mixtures thereof.

In some alternative embodiments, the present invention includes a method to use a Cr(VI) reducing formulation, comprising applying the formulation on a Cr(VI) contaminated surface;

waiting for a suitable amount of time while the surface undergoes a visible color change; and evaluating the completion of the Cr(VI) reduction by comparing the color of the surface to one or more colors on a reference color tool.

Preferably, the formulation includes (1) a reactive reducing agent comprising at least one reducing chemical capable of reducing Cr(VI) to Cr(III); and (2) one or more solvents.

More importantly, the present invention includes a Cr(VI) reduction kit which comprises (1) a Cr(VI) reducing formulation; and (2) at least one color reference tool for evaluating the process and/or completion of the Cr(VI) reduction.

Preferably, the color reference tool comprises one or more colors, in which at least one color indicates the completion of the chromate reduction. The formulation preferably includes (1) a reactive reducing agent comprising at least one reducing chemical capable of reducing Cr(VI) to Cr(III); and (2) one or more solvents.

In some alternative embodiments, the present invention includes a formulation to reduce Cr(VI) in a coating, comprising:

a. a reactive reducing agent comprising at least one reducing chemical capable of reducing Cr(VI) to Cr(III); and b. one or more organic compounds.

Preferably, the organic compounds are organic acids, other similar compounds, or a mixture thereof. Suitable examples of the organic acids include acetic acid, formic acid, other similar acids, and a mixture thereof.

According to some further embodiments, the formulation includes one or more organic solvents. Preferably, the organic solvent comprises isopropyl alcohol, acetone, other similar organic solvents, or a mixture thereof.

DETAILED DESCRIPTION OF THE INVENTION AND BEST MODE

Figure 1:
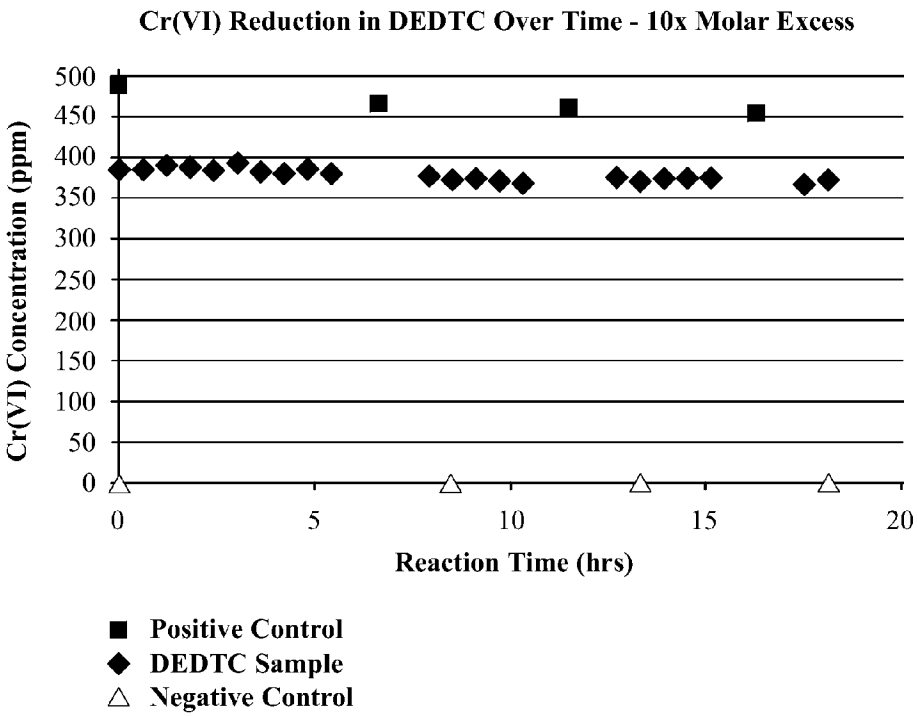
FIG. 1 is a diagram of Cr(VI) concentration (ppm) over 20 hours of reaction time between Cr(VI) and sodium diethyl dithiocarbamate (DEDTC), wherein DEDTC was at 10-fold molar excess to the amount of the dissolved Cr(VI), illustrating the efficiency of 10-fold molar excess DEDTC on reducing the dissolved Cr(VI) over time.

Broadly, this invention provides for formulations and methods useful in reducing Cr(VI) contamination in the environment, particularly for the process of removing or stripping Cr(VI) containing paints, conversion coats, primers, topcoats, caulks, adhesives, or other finishes. Such formulations and methods are especially useful in applications such as metal surface refinishing work areas in metal surface refinishing shops, field maintenance of equipment and weapon systems, and the other similar processes. Hexavalent chromium can also be called "chromate", "Cr (VI)", "$Cr^{VI}$", or "$Cr^{+6}$".

The advantages of the present invention include (1) being able to reduce Cr(VI) to harmless Cr(III), reducing the exposure to the operator and environment; (2) the formulation is low in toxicity; and (3) the formulation is compatible with the substrate; or alternatively, the formulation is compatible with the substrate within the exposure time period, such as within a few hours, then the formulation can be neutralized. More importantly, the present invention has the advantage of using the accompanying color change to evaluate the completion of the Cr(VI) reduction reaction. The color change associated with Cr(VI) reduction makes the present invention a convenient and non-hazardous way to reduce Cr(VI) for operators working with the Cr(VI) painting or coatings. Operators can avoid the environment when the Cr(VI) reduction is not complete, and they do not need to do any further testing to confirm the completeness of the reduction.

The formulation of the present invention reduces Cr(VI) by converting Cr(VI) to Cr(III), a far less reactive and less toxic oxidation state of chromium. The formulation comprises at least one reactive reducing agent (RR agent) and one or more solvents. The RR agent includes at least one reducing chemical capable of converting or electrochemically reducing Cr(VI) to Cr(III) in solution and/or in solid form. Preferably, the reducing chemical is a thio or mercaptan compound; and most preferably, it is a small molecule with high diffusion rate through polymeric coatings such as topcoats, primers, paints, caulks, and/or adhesives. Hydroxylamine, hydrogen sulfide ion, and mildly acidic hydrogen peroxide are examples of small molecule RR agents that be formulated, preferably with penetrating fluids and oils, to penetrate top coats and primers. For purposes of the present invention, unless otherwise specified, the word "coating" can refers to top coats, primer coating, and conversion coating individually or in combination.

Alternately, the RR agent could be a non-toxic acid that will not be corrosive to the substrates, such as ferrous and non-ferrous substrates. Suitable examples of the non-toxic acids can be, but are not limited to, acetic acid, formic acid, propionic acid, ascorbic acid, or other similar acids.

In this application, the solvent can also be referred to as a carrier agent or a carrier. The solvent can be water, but preferably a formulated aqueous-based degreaser, a paint stripper, an organic solvent or other formulated cleaner, and most preferably an oil based degreaser, paint stripper, and the like, or stable or unstable emulsions or dispersions thereof. Specifically, suitable solvent or water-based carrier formulations should help the reactive RR agent penetrate a paint coating to enable the RR agent to reach soluble or insoluble Cr(VI) compound(s) so that the RR agent can convert the Cr(VI) to Cr(III) within the conversion coating and paint coating.

Examples of the reducing chemical, include but are not limited to, water soluble thiol compounds, sulfites, sulfides, dithionite, sulfur dioxide, ferrous salts, hydroxylamines and the like, solvent soluble thiol compounds, oil soluble mercaptan, disulfide, thio-ethers, other similar organosulfur compounds or derivatives, or a mixture thereof. Preferably, the reducing chemical includes water soluble thiol compounds. Dithiothreitol ((2S,3S)-1,4-Bis-sulfanylbutane-2,3-diol, or short as DTT), diethyldithiocarbamate ion (DEDTC), and salts of monohydrogen sulfide ion ($HS^-$) are especially effective examples of suitable reducing chemicals, especially for oil/water or water based carrier systems, that could be used alone or blended together.

Alternatively, the reducing chemical can be an oil soluble thio or thiol compound. Disulfide is an effective organosulfur non-thiol alternative with a high oil solubility and exceptional Cr(VI) reducing capability. Solvent based reducing chemicals are preferred when the organic solvents are used to help the reducing chemicals penetrate the paint or other type of coating to convert Cr(VI) to Cr(III). Particularly effective oil soluble thiol or thio compounds can be Cyanex® 301, Cyanex® 302, or a mixture thereof. Cyanex® 301 is a dialkyl dithiophosphinic acid extractant, containing 75-80% bis(2,4,4-trimethyl pentyl)dithiophosphonic acid with a-S terminal and a-SH terminal. Cyanex® 302 has bis(2,4,4-trimethylpentyl)monothiophosphinic acid as its major component. Preferred levels of sulfur-based RR agents range from 1 to 10% by weight.

For applications where sulfur-based reducing chemicals cannot be used, such as due to odors or excessive corrosion, suitable non-sulfur reducing chemicals can be used to reduce or eliminate the amount of the sulfur-based reducing chemicals in the Cr(VI) reducing formulation. Alternatives to sulfur-based reducing chemicals include, but are not limited to, acids and salts of one or more of the following: ascorbic acid, ascorbate, sorbate, sorbic acid, acetic acid, propionic acid, butylated hydroxytoluene, butylated hydroxyanisole, tert-butylhydroquinone, propyl gallate, glycolic acid (or hydroxyacetic acid) and other α-hydroxy acids (AHA), formic acid, the salts thereof, and combinations or mixtures thereof.

Effective inorganic reducing chemicals are believed to include thiosulfate and thiosulfite ion materials, ferrous ion containing materials, stannous containing materials, hydroxylamine, oxalic acid, manganese(II) ion, vanadium(II) ion, chromium(II) ion, alkyl peroxides, hydrogen peroxide, percarbonate, perborate, and the like. In some embodiments, reducing chemicals can be suitable gaseous compounds, which include but are not limited to, phosphine, carbon monoxide, sulfur dioxide, formaldehyde, methanol vapor, nitric oxide (NO), hydrogen gas ($H_2$), $H_2S$, a borane, borohydride ion materials, nitrite ion materials, phosphite, hypophosphite, and the like. These reducing chemicals can be used as gases, solids, solutions, or a part of formulation with the solvent(s) described elsewhere in this application.

Other suitable reducing chemicals might include bases, such as, hydroxylamine, methanol, propanol, acetone or other ketones, acetaldehyde, other aldehydes, hydroquinone, propionaldehyde, sodium borohydride, methyl magnesium chloride, hydrazine, and combinations or mixtures thereof. Of course, the suitable bases must be non-corrosive within the few hours of applying the reducing formulations of the present invention. After a few hours, the bases can be neutralized to avoid possible damage to the metal substrate.

Preferably, the concentration of the RR agent or the reducing chemical(s) in the formulation of the present invention can be 0.001 to 0.01% by weight, preferably 0.01 to 0.1%, and most preferably 0.1-1.0% by weight of the formulation. If the formulation comprises more than 1 wt % reducing chemical, it is still effective; however, this level might be excessive in some instances. For example, such excessive reducing chemical within the RR agent might become corrosive to the substrate or cause other problems.

According to some embodiments of the present invention, the suitable solvents (also called carrier systems) include the following: water, toluene, acetone, ethanol, isopropyl alcohol (IPA), methyl ethyl ketone (MEK), methyl isopropyl ketone, glycol ether, methyl isobutyl ketone (MIBK), Graf Off® cleaner, GOOP® cleaner, GO-JO® cleaner, other similar degreasers or degreasing agents, paint stripper or remover, such as dichloromethane, Perc (perchloroethylene), Trichlor (TCE, trichloroethylene), turpentine, linseed oil, propylene glycol, trypropylene glycol methyl ether, D-limonene, other limonene, citrus extracts, N-methyl pyrrolidone (NMP), alkyl esters of succinic, adipic, and/or glutaric acids, aromatic hydrocarbons, dimethylformamide, dimethyl sulfone (DMSO), propylene carbonate, chloroform, carbon tetrachloride, ethyl acetate, skin-penetrating hand creams and ointments, or a blend or a mixture thereof.

Degreasers or degreasing reagents refer to cleaning agents specially designed and made for removal of grease, oil, and depainting. These may be solvent-based or solvent-containing, and may also have surfactants, dispersants, or other chemicals, as active ingredients. The solvents have a dissolving action on grease, and can act as a dispersant for dirt and other particulates. The solvent-containing degreaser may have an alkaline washing agent added to a solvent to promote further degreasing or dispersion. Degreasing agents may also be made solvent free based on alkaline chemicals and/or surfactants.

Paint strippers or paint remover is the generic name given to solvent mixtures designed to remove paint, top coats, adhesives, and other finishes. The principal active ingredient is usually dichloromethane, toluene, Methyl isobutyl ketone (MIBK), methyl ethyl ketone (MEK), xylene, benzyl alcohol, or other similar chemical compounds. The molecules of the active ingredient penetrate the paint film, causing the swelling of the paint film. This swelling of the paint volume causes internal strains, which, together with the weakening of the layer's adhesion to the underlying surface, leads to separation of the layer of the paint from the substrate.

In some embodiments of the present invention, the concentration of the paint strippers and/or degreasers in the reducing formulation should be low enough so as not to strip the paint from the surface, but must be of a sufficient level to assist the electrochemical RR agent to penetrate and migrate inside of the paint coating or film without significantly disturbing said coating. Once inside the paint film, the reducing chemical can obtain access to Cr(VI) so as to convert it to Cr(III). The painting includes top coat, coating, primer, and/or conversion coating.

In some alternative embodiments of the present invention, the concentration of the paint strippers should be high enough to strip or remove the paint from the surface of the substrate; however, the concentration should be low enough to avoid damage to the substrate. In this way, the formulation of the present invention is capable of stripping the paint and reducing Cr(VI) to Cr(III) during a singular process. This singular process of reducing and stripping provides a simplified inexpensive process of stripping Cr(VI) paints with minimum or no exposure to the hazards of Cr(VI) dusts.

In some further embodiments of the present invention, the Cr(VI) reducing formulation includes an effective amount of one or more chelating agents. As used herein, the terms "chelating agent" and "sequestrant" refer to a compound that has the ability to bond to a metal ion through two or more atoms of the chelating agent to form a complex or a reaction product. The bonds may be covalent or ionic or a combination thereof. Examples of suitable chelating agents include, but are not limited to, ethylenediamine tetraacetic acid and its salts, nitrilo triacetic acid (NTA), sodium tripolyphosphate, other polyphosphate, phosphonic acids, hydroxy carboxylic acid, diethylene triamine pentaacetic acid (DTPA), sodium glyconate, sodium citrate, the alkali metal salts of these acids, calcium chelating agents, barium chelating agents, and combinations and mixtures thereof. The chelating agent typically is added to the aqueous dispersion such that the weight ratio of the chelating agent to the RR agent or agents in the range of 0.1 to 10 molar concentration (M).

Other optional ingredients include deicing formulation such as "gel coat" formulation, activators, emulsifying agents, pH adjusting agents, surfactants, viscosity modifiers, gelling agents, or a mixture thereof. The pH adjusting agents, such as NaOH, acids (such as acetic acid), are desirable ingredients to alter the pH of the reducing formulation for purposes of increasing the reactivity of the RR agent, improving the extraction efficiency, and/or enhancing the penetration of the RR agent into the coating to react with Cr(VI) as shown in the examples. The type of pH adjusting agents, whether basic or acidic, can be chosen according to the type of the Cr(VI) compound, the type of the coating, or other environmental factors. For example, if the coating is very basic, using an acidic pH adjusting agent to reduce the pH can enhance the reactivity of the RR agent as the Cr(VI) might be converted to a more reactive form at a lower pH. However, if the coating is already very acidic, such as the formic acid based coating, a more basic pH adjusting agent might be needed to increase the pH improve the extraction efficiency or penetration, or making the coating more compatible with a more basic RR agent.

Deicer formulation can be added to the RR agent, which will assist the RR agent to penetrate into the coating to access Cr(VI) so that the RR agent can reduce Cr(VI) into Cr(III). The best part is that the deicer formulation can achieve the penetration without dissolving the top coat of the painting.

Thickeners, gelling agents and/or emulsifying agents can help the reducing formulation adhere onto painted surfaces, especially when that surface is slanted, vertical, overhead, or any similar position where the reagent or the reducing formulation can easily slide off the surface. Further, they can reduce the evaporation of solvents, which provides for a longer exposure time for the RR agent to react with Cr(VI) in the coating. Suitable examples of the thickeners are hydroxypropyl cellulose, paraffin wax, polyacrylates, polyacrylamides, polyethylene, or polyethylene derivatives.

Activators can be used to increase the penetration rate. The activator's role is to disrupt or swell the molecular and intermolecular bonds in the paint film and assist with weakening it. In other words, the activator can expand the molecular and intermolecular bonds in the paint film so as to allow diffusion of the reducing chemicals into the paint film.

For degreasers, such as dichloromethane, a water based emulsion is particularly suitable. Water based degreasers wet the polymer matrix of the coating. After the water molecules from the degreasers enter into the polymer matrix of the coating, they promote dissolution and solubilization of Cr(VI) salts, creating an aqueous interface inside of the paint coating. At the same time, the degreasers transport the reducing chemical to the aqueous interface where the reducing agent can react with the dissolved Cr(VI) ion or wetted chromate(VI) salt to convert it to Cr(III).

Surfactants assist with wetting the surface, increasing the area of where the solvent can penetrate the paint layer. Suitable surfactants include dodecyl benzene sulfonate, sodium xylene sulfonate, and other anionic surfactants, and/or nonionic surfactants, such as polyethoxylates, and the like.

In addition, the present invention includes methods of reducing Cr(VI) contamination. This method can be applied to the following processes to reduce Cr(VI) to Cr(III):

- the process of re-finishing or removing Cr(VI) paints or finishes;
- the application of Cr(VI) containing chemical conversion coatings to the surfaces of various ferrous and non-ferrous substrates;
- the application and chemical stripper removal of Cr(VI) containing primers, sealants, and adhesives;
- the clean-up of Cr(VI) containing paint mixing and application equipment;
- the clean-up and disposal of Cr(VI) contaminated tape and masking materials, paint booth filters, PPE, rags, and non-used coatings, sealants and adhesives;
- wet or moisture-assisted Cr(VI) related sanding operations; and
- chemical wipes for Cr(VI) contaminated surfaces and spill containment.

Broadly, the method of the present invention includes the following steps:

a) Applying to a surface of a paint coating or finishing a Cr(VI) reducing formulation, wherein the formulation comprises (1) a reactive RR agent comprising at least one reducing chemical capable of reducing Cr(VI) to Cr(III), and (2) one or more solvents;
b) Applying the formulation to a paint coating or finishing;
c) Allowing the formulation to convert Cr(VI) to Cr(III) in the paint coating or finishing; and
d) Removing or refinishing the paint coating.

The accompanying visual observations of color change are unique to the Cr(VI) reduction process of the present invention. Specifically, the visible color change varies according to the degree of reduction of Cr(VI) to the Cr(III). The sequence of color change includes the yellow base state (untreated Cr(VI)) to orange to light brown to dark green to dark blue/green to dark brown/purple. A correlation of the percent reduction to the respective colors will be provided in a circular "color wheel" that can be used to visually assess the level of Cr(VI) reduction prior to proceeding with any maintenance operation.

The Cr(VI) reducing formulations used in the method of the present invention have been discussed in detail above. The method applies such formulation as a coating to the surface of the paint coating. According to some embodiments of the method of the present invention, the reactive RR agent alone can be used as the Cr(VI) reducing formulation. Then, a suitable amount of time is allowed for the formulation to convert Cr(VI) to Cr(III) in the paint coating or finishing. After Cr(VI) reduction, the treated paint coating can then be removed mechanically, such as by sanding or grit blasting, or chemically by using an excess amount of paint stripper, in the conventional manner. The paint removal can also be followed by desired surface finishing by known methods, which add to the stripped surface a new layer of hexavalent chrome or a hexavalent chrome alternative painting.

The reducing formulation of the present invention can be prepared for a period of time before the application or usage. Alternatively, the RR agent can be added to the solvent to make the formulation of the present invention immediately prior to applying the Cr(VI) reducing formulation to the paint coating. The solvent helps spreading the RR agent across the surface of the coating, then assists with the penetration of the RR agent into the paint to convert Cr(VI) inside of the paint. After a suitable amount of time, a few hours to overnight, most of or all Cr(VI) in the paint coating can be converted into Cr(III). After the treatment method of the present invention, during the paint removing process, the paint dust from the treated paint would not contain any significant amount of Cr(VI).

Moreover, the present invention includes a Cr(VI) reduction kit, which comprises a Cr(VI) reducing formulation; and at least one color reference tool for evaluating the process and/or completion of the Cr(VI) reduction. Preferably, the color reference tool comprises one or more colors, in which at least one color indicates the completion of the Cr(VI) reduction. The formulation comprises (a) a RR agent comprising at least one reducing chemical capable of reducing Cr(VI) to Cr(III); and (b) one or more solvents. The formulation can be any of the formulations discussed above.

As discussed above, the process of the Cr(VI) reduction using the formulation of the present invention has a unique advantage of associated visibly detectable color changes, corresponding to various stages of the Cr(VI) reduction. For example, the sequence of color changes include the yellow base state (untreated Cr(VI)) to orange to light brown to dark green to dark blue/green to dark brown/purple. The exact tints and hues of the colors at different stages of Cr(VI) reduction may exhibit some variations due to, inter alia, different RR agents, other components of the Cr(VI) reducing formulations, the nature and/or state of the coating (primer, top coat, and/or otherwise), and other factors. It may therefore be desired to provide the user of the present invention with a color reference tool. The tool may be used to assist the user in interpreting the color of the surface after applying the present invention, especially when the differences in the colors associated with Cr(VI) reduction are subtle.

The color reference tool can be circular ("the color wheel") or rectangular, or any other suitable shape. It may be made of a paper, cardboard card, or any other suitable material. A color reference tool can have several colors, corresponding to various stages of the Cr(VI) reduction for any particular formulation. It must have at least one color indicating the completion of the Cr(VI) reduction.

For some preferred embodiments, the color reference tool can have one or more colors and one or more interpreting marks associated with the colors. The colors approximately represents the colors which are developed by each stage of the Cr(VI) reduction after the RR agent is applied to the Cr(VI) material. The color can be printed on or otherwise applied to a portion of the surface of the color reference tool.

The interpreting mark can be text and/or number. For example, the interpreting mark can include the words "reduction on-going," or "reduction complete." Or the interpreting mark can be "100% complete," or "100%," which denotes the percentage of Cr(VI) reduction. Other types of interpreting marks may be used such as differently worded instructions, the numbers representing the value of the Cr(VI) reduction levels corresponding to the color on the reference tool associated with the interpreting mark. Alternatively, the interpreting mark can be non-text like marks such as icons, pictures or other sign-like symbols which assist in the interpretation of the color of the contaminated surface or provide instructions of how to proceed when the color of the surface is similar to one of the colors on the color reference tool.

In some preferred embodiments, an optional cover with an open slot can be added to the tool. The cover can be easily moved along the surface of the tool in a circular motion or other suitable motions, so that the open slot can show the appropriate color corresponding to the suitable stage of the Cr(VI) reduction. Any other similar color reference tool can also be used.

In some alternative embodiments, the present invention includes a formulation to reduce Cr(VI) in a coating, comprising:

a. a reactive reducing agent comprising at least one reducing chemical capable of reducing Cr(VI) to Cr(III); and b. one or more organic compounds.

Preferably, the organic compounds are organic acids, other similar compounds, or a mixture thereof. Suitable examples of the organic acid include acetic acid, formic acid, other similar acids, and a mixture thereof. The organic acid can have a dual function of digesting the polyamide frame work of the coating (extracting Cr(VI)), and working with the reducing agent to reduce Cr(VI). For example, formic acid can reduce Cr(VI) by itself albeit at a slower rate.

According to some further embodiments, the formulation includes one or more organic solvents. Preferably, the organic solvent comprises isopropyl alcohol, acetone, other similar organic solvents, or a mixture thereof. The organic solvent can add viscosity to the formulation, and can also assist in disbanding the primer coating from the substrate at the same time.

EXAMPLES

The following examples illustrate various aspects of the invention and are not intended to limit the scope of the invention in any way.

Example 1

This example evaluated the effectiveness of several RR agents at reducing Cr(VI) in strontium chromate powder ($SrCrO_4$) in liquid. Three different RR agents were evaluated: dithiothreitol, sodium diethyldithiocarbamate trihydrate, and Cyanex® 301. The active component of Cyanex® 301 extractant is bis(2,4,4-trimethylpentyl)dithiophosphinic acid, which is about 75 wt % of Cyanex® 301, and it is manufactured and sold by Cytec. Strontium Chromate powder was mixed with a roughly 5-fold molar excess of each of the three RR agent solutions and allowed to interact overnight. Mixtures of methyl ethyl ketone (MEK) and high-purity deionized water (HPDI water or $H_2O$) were used as the solvents: 1 v/v % MEK/HPDI water and 1:2 MEK/HPDI water.

Procedure:

1. Prepared the RR agent solutions: Added an appropriate amount of dithiothreitol, sodium diethyldithiocarbamate trihydrate (DEDTC), or Cyanex® 301 to the appropriate mixture of methyl ethyl ketone (MEK) and high-purity deionized water (HPDI or just as $H_2O$) as shown in Table 1.1% $H_2O$/MEK (v/v) was prepared ahead of time, while 1:2 $H_2O$/MEK (v/v) was prepared along with the RR agent-sodium diethyldithiocarbamate trihydrate. For 1:2 $H_2O$/MEK, $H_2O$ and MEK were added to sodium diethyldithiocarbamate trihydrate separately at a 1:2 ratio until the final volume of 35 ml was achieved.

TABLE 1

Formulation for RR agent Solutions

| RR agent Solutions | Weight of RR agent (g) | Carrier (Solvent) | Final Vol. (mL) |
|---|---|---|---|
| 2.3M Dithiothreitol | 7.1 | 1% $H_2O$/MEK (v/v) | 20 |
| 1.1M Sodium diethyldithiocarbamate trihydrate (DEDTC) | 8.7 | 1:2 $H_2O$/MEK (v/v)** | 35 |
| 1.7M bis(2,4,4-trimethylpentyl)dithiophosphinic acid* | 16.5 | 1% $H_2O$/MEK (v/v) | 30 |

*active ingredient in Cyanex ® 301 at approximately 75 wt %

**The two solvents were added to the RR agent separately but in a 1:2 ratio until the final volume was achieved. MEK and water were immiscible at this ratio, but in the presence of the RR agent, the solution was homogeneous.

2. Weighed 500 mg (±2%) of strontium chromate ($SrCrO_4$) powder into each of twelve glass centrifuge tubes with PTFE-lined screw caps. In some instances, prior to use, the strontium powder was milled by using a mortar and pestle until it had the consistency of a very fine powder.
3. Prepared the step 2 centrifuge tubes ("tube") as described below:
   a. Added nothing to two tubes (Positive Control).
   b. Added 16.7 mL of 1:2 $H_2O$/MEK (v/v) to two tubes (Blank #1).
   c. Added 14.4 mL of 1% $H_2O$/MEK (v/v) to two tubes (Blank #2).
   d. Added 8.0 mL of the dithiothreitol solution to two tubes.
   e. Added 16.7 mL of the diethyldithiocarbamate (DEDTC) solution to two tubes.
   f. Added 14.4 mL of the Cyanex® 301 solution to two tubes.
4. Capped the tubes securely and placed them in a laboratory tumbler.
5. One hour later, put the sample tubes into the tumbler, and allowed the samples to tumble end-over-end overnight (~14 hours) at 1-1.5 cycles/second to provide sufficient mixing of the RR agent solution with the strontium chromate powder. The approximate reaction time was about 18.5 hours.
6. Centrifuged the sample tubes at about 3,000 rpm for about 20 minutes.
7. Removed the liquid by decanting and/or pipetting to remove as much of the liquid as possible.
8. Dried the samples (solids) using a gentle stream of nitrogen in a water bath at about 35° C. for about 2 hours.
9. The samples were analyzed for Cr(VI) using an Ion Chromatography (IC) system with a Dionex IonPac AS11 4×250 mm analytical column, KOH gradient elution, 2 ml/min flow rate, Electrochemical Detection (ECD) with 50 mA suppression current.

Observation and Results:

TABLE 2

Observations of Samples

| Samples | Pre-reaction | Post-Reaction (after Centrifugation) |
|---|---|---|
| Blank #1 | Top: clear/slightly yellow MEK phase<br>Middle: yellow aqueous phase<br>Bottom: bright yellow solids ($SrCrO_4$) | Top: colorless MEK layer<br>Middle: slightly yellow aqueous layer<br>Bottom: bright yellow solids |
| Blank #2 | Top: slightly yellow aqueous/MEK phase<br>Bottom: bright yellow solids ($SrCrO_4$) | Top: colorless MEK layer<br>Bottom: bright yellow solids |
| Dithiothreitol | Bright yellow solution/emulsion upon mixing; a few seconds after mixing, the solid SrCrO4 settled but the liquid phase remained bright yellow | Same as that of Blank #2 |
| DEDTC | Bright yellow solution/emulsion upon mixing; solids settled a few seconds after mixing | Top: bright yellow solution*<br>Bottom: bright yellow solids |
| Cyanex ® 301 | Bright yellow solution/emulsion upon mixing; a few minutes after mixing, the solid settled but the liquid remained bright yellow; after 15 minutes, the liquid took on a brownish purple color. | Top: Brownish-purple liquid layer<br>Bottom: bright yellow solids |

*After removing the liquid phase from the sample centrifuge tube, it was let sit for about 24 hours, at which time the solution found to be a green color.

Conclusion:

The color changes were observed for the DEDTC samples (bright yellow to green) and for the Cyanex® 301 samples (bright yellow to brownish-purple). The changes in color are indicative of the presence of hydrated Cr(III) complexes.

The IC results showed that the blank #1 (1:2 $H_2O$/MEK solution) contained a sufficient quantity of $SrCrO_4$ while the blank #2 (1 v/v % $H_2O$/MEK solution) did not have enough $SrCrO_4$. The results also show that Cr(VI) was not detected in the samples containing DEDTC. It was possible that DEDTC was very effective in reducing Cr(VI). It was also apparent that some of Cr(VI) failed to dissolve in the MEK/$H_2O$ mixtures, hampering the reduction activity of the present invention. To evaluate whether or not the present invention can reduce Cr(VI), it might be desirable to prepare a solution of dissolved Cr(VI), and/or changing the strontium chromate into another more soluble chromate compound.

Example 2

This example evaluated the effectiveness of the RR agents on reducing the dissolved Cr(VI) over time. The RR agents were sodium diethyl dithiocarbamate (DEDTC), dithiothreitol (DDT), and sodium dithionite (dithionite). The solvent for DEDTC and DDT was methyl ethyl ketone (MEK) saturated water, which referred to about 28 v/v % MEK in water. The solvent for dithionite is 10 v/v % MEK in water. The water was high-purity deionized water (also called HPDI water or $H_2O$). The source of Cr(VI) used for testing was sodium dichromate dihydrate ($Na_2Cr_2O_7.2H_2O$).

Procedure:

A 47.31 mg/ml Cr(VI) solution ("chromate solution") was prepared by dissolving 288.0 mg $Na_2Cr_2O_7.2H_2O$ in 2.00 ml HPDI water. Each of the RR agents were evaluated at 10-fold and 50-fold molar excess in comparison to the amount of the Cr(VI): Each RR agent was first dissolved in the appropriate solvent at a concentration that facilitated the molar excesses described above (concentrations listed in Table 3). An appropriate amount of the chromate solution was then added to each RR agent solution just prior to injection into the Ion Chromatography (IC) system (within about one minute).

All samples were analyzed for Cr(VI) over a period of 16 to 25 hours using an Ion Chromatography (IC) system with a Dionex IonPac AS11 4×250 mm analytical column, KOH gradient elution, 2 ml/min flow rate, Electrochemical Detection (ECD) with 50 mA suppression current. Immediately (about one minute) after addition of the chromate solution to each RR agent solution, the first injection was added into the IC system. Subsequent injections were made by the IC system at regular intervals over a period of about 16 to about 25 hours. The results are shown in Table 4:

TABLE 3

RR Agent Formulations.

| RR agent | Formulation | Ingredients | Positive Control | Negative Control |
|---|---|---|---|---|
| DEDTC | 10-fold molar excess | 15.9 μl of 47.31 mg/ml Cr(VI)* in 1.5 ml of 0.144M DEDTC | 15.9 μl of 47.31 mg/ml Cr(VI)* in 1.5 ml of MEK saturated water | 0.144M DEDTC (in MEK saturated water) |
| | 50-fold molar excess | 15.9 μl of 47.31 mg/ml Cr(VI)* in 1.5 ml of 0.722M DEDTC | 15.9 μl of 47.31 mg/ml Cr(VI)* in 1.5 ml of MEK saturated water | 0.722M DEDTC (in MEK saturated water) |
| DTT | 10-fold molar excess | 15.9 μl of 47.31 mg/ml Cr(VI)* in 1.5 ml of 0.144M DTT | 15.9 μl of 47.31 mg/ml Cr(VI)* in 1.5 ml of MEK saturated water | 0.144M DTT (in MEK saturated water) |
| | 50-fold molar excess | 13.0 μl of 47.31 mg/ml Cr(VI)* in 1.5 ml of 0.720M DTT | 13.0 μl of 47.31 mg/ml Cr(VI)* in 1.5 ml of MEK saturated water | 0.720M DTT (in MEK saturated water) |
| Dithionite | 10-fold molar excess | 15.9 μl of 47.31 mg/ml Cr(VI)* in 1.5 ml of 0.144M dithionite | 15.9 μl of 47.31 mg/ml Cr(VI)* in 1.5 ml of 10% MEK/water | 0.144M dithionite (in 10% MEK/water) |
| | 50-fold molar excess | 15.9 μl of 47.31 mg/ml Cr(VI)* in 1.5 ml of 0.720M Dithionite | 15.9 μl of 47.31 mg/ml Cr(VI)* in 1.5 ml of in 10% MEK/water | 0.720M Dithionite (in 10% MEK/water) |

*47.31 mg/ml Cr(VI) was prepared by adding 288.0 mg $Na_2Cr_2O_7 \cdot 2H_2O$ in 2 ml of HDPI water.

Figure 2:
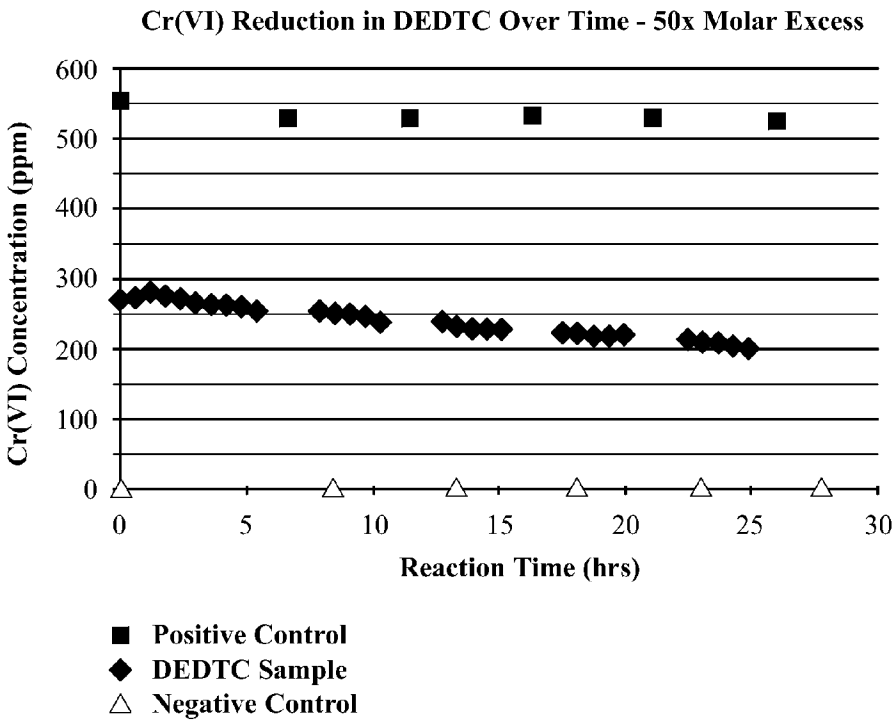
FIG. 2 is a diagram of Cr(VI) concentration (ppm) over 30 hours of reaction time between Cr(VI) and sodium diethyl dithiocarbamate (DEDTC), wherein DEDTC was at 50-fold molar excess to the amount of the dissolved Cr(VI), illustrating the efficiency of 50-fold molar excess DEDTC on reducing the dissolved Cr(VI) over time.
Figure 3:
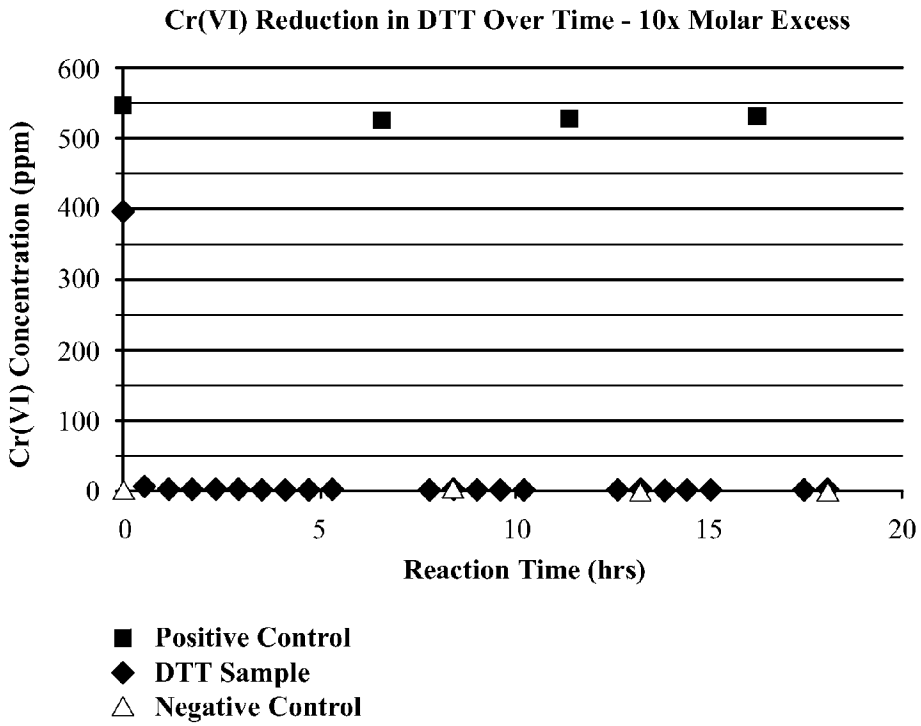
FIG. 3 is a diagram of Cr(VI) concentration (ppm) over 20 hours of reaction time between Cr(VI) and dithiothreitol (DTT), wherein DTT was at 10-fold molar excess to the amount of the dissolved Cr(VI), illustrating the efficiency of 10-fold molar excess DTT on reducing the dissolved Cr(VI) over time.
Figure 4:
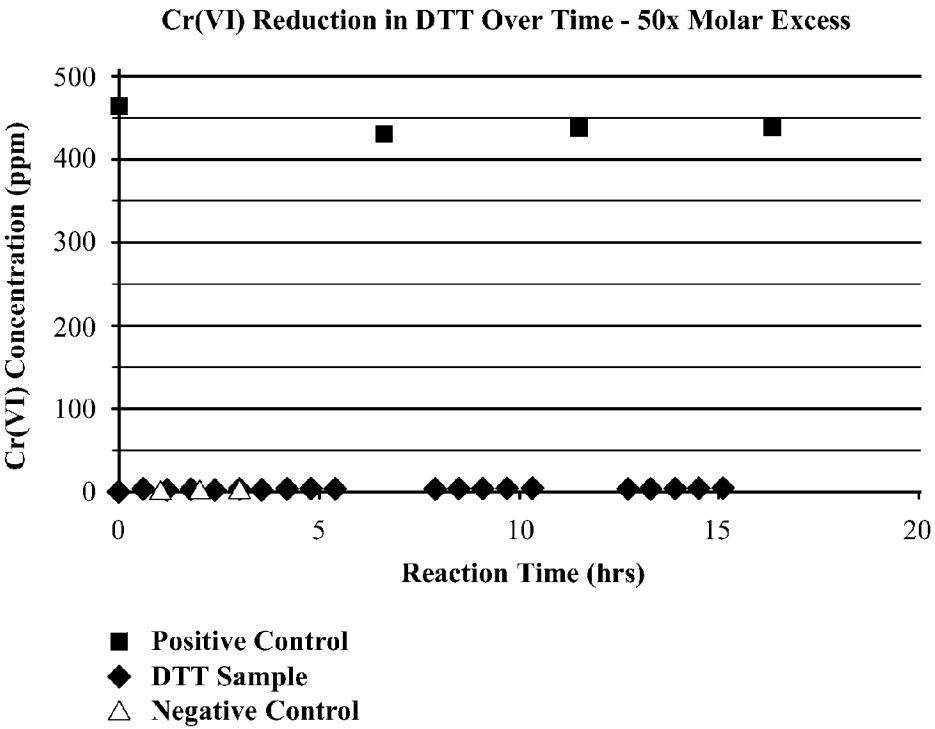
FIG. 4 is a diagram of Cr(VI) concentration (ppm) over 20 hours of reaction time between Cr(VI) and dithiothreitol (DTT), wherein DTT was at 50-fold molar excess to the amount of the dissolved Cr(VI), illustrating the efficiency of 50-fold molar excess DTT on reducing the dissolved Cr(VI) over time.
Figure 5:
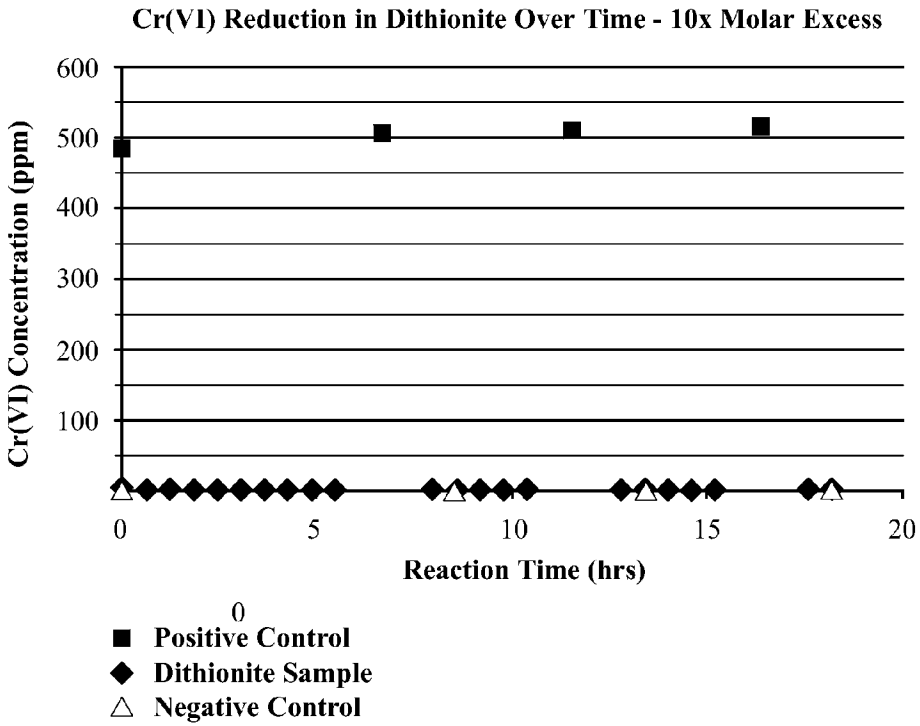
FIG. 5 is a diagram of Cr(VI) concentration (ppm) over 20 hours of reaction time between Cr(VI) and sodium dithionite (Dithionite), wherein Dithionite was at 10-fold molar excess to the amount of the dissolved Cr(VI), illustrating the efficiency of 10-fold molar excess Dithionite on reducing the dissolved Cr(VI) over time.
Figure 6:
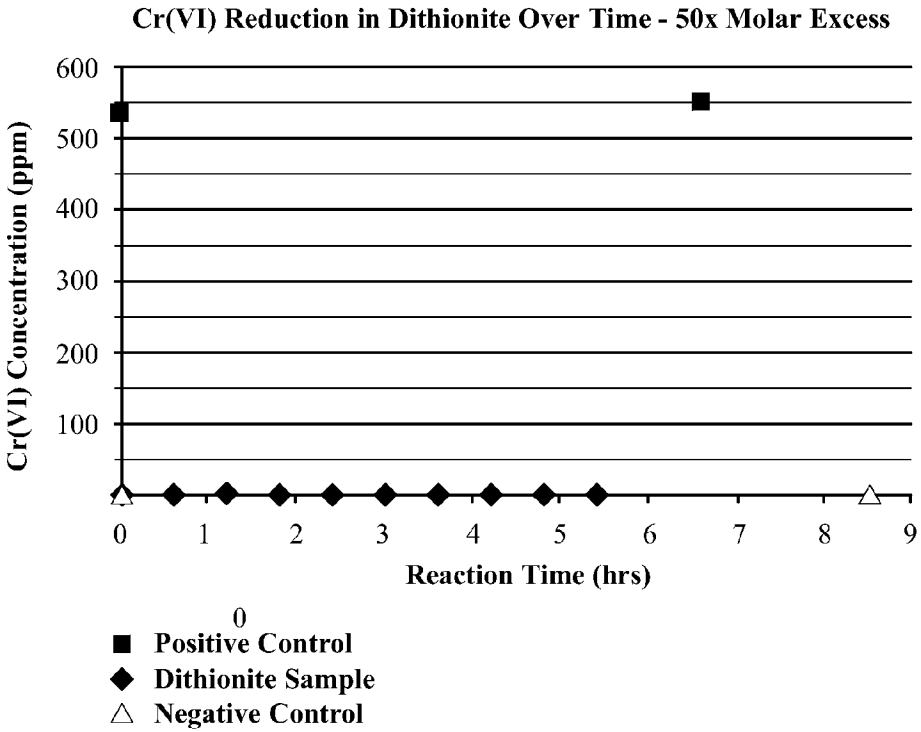
FIG. 6 is a diagram of Cr(VI) concentration (ppm) over 9 hours of reaction time between Cr(VI) and sodium dithionite (Dithionite), wherein Dithionite was at 50-fold molar excess to the amount of the dissolved Cr(VI), illustrating the efficiency of 50-fold molar excess Dithionite on reducing the dissolved Cr(VI) over time.

Results:

FIGS. 1 and 2 show the results of Cr(VI) reduction in DEDTC over time up to 16 to 30 hours. FIGS. 3 and 4 show the results of Cr(VI) reduction in DTT over time up 16 to 20 hours. FIGS. 5 and 6 show the results of Cr(VI) reduction in Dithionite over time up to 20 hours. Table 4 details the final results along with some observations as to the color changes associated with the reactions.

TABLE 4

Results and Visual Observations

| RR agent | Fold Excess over Cr(VI) | Percent Reduction: 1 minute | Percent Reduction: 15-24 hours | Observation | Pro | Con |
|---|---|---|---|---|---|---|
| DEDTC | 10-fold | 20% | 20% (18 hrs) | Green precipitate observed immediately upon mixing, filtrate was still bright yellow after removing the precipitate | Reduction indicated by color change | Strong "sulfur" odor, reaction produce precipitate, incomplete removal of Cr(VI) |
| | 50-fold | 50% | 60% (24 hrs) | After the green (Cr(III))precipitate was | | |

TABLE 4-continued

| Results and Visual Observations | | | | | | |
|---|---|---|---|---|---|---|
| | | Percent Reduction | | | | |
| RR agent | Fold Excess over Cr(VI) | 1 minute | 15-24 hours | Observation | Pro | Con |
| | | | | removed, the liquid was yellow, indicating some residual Cr(VI) presence. | | |
| DTT | 10-fold | 30% | 99+% (15 hrs) | Changed color gradually within a couple minutes from yellow→brown→green→dark green. | Reduction indicated by color change | Sulfur odor, prone to oxidation |
| | 50-fold | 99% | 99+% (15 hrs) | Within 15 to 20 seconds, the color changed from yellow→brown→green→dark green. | | |
| Dithionite | 10-fold | 99% | 100% (18 hrs) | The solution became brownish yellow immediately. Within 20-30 seconds, the color changed gradually into a teal color. | Reduction indicated by color change, no precipitation observed at the beginning | Weak sulfur odor, oxidizes rapidly in solution |
| | 50-fold | 100% | 100% | The color turned to brown immediately, and then within a few seconds, the color turned to green/teal. | | |

Conclusion:

The results in Table 4 show that the reducing agents were effective in reducing Cr(VI). More interestingly, the results show that such reduction reactions were indicated by color change. The color change associated with Cr(VI) reduction makes our invention a convenient and non-hazardous way to reduce Cr(VI) for operators working with the Cr(VI) painting or coatings. Operators can avoid the environment when the Cr(VI) reduction is not complete, and they do not need to do any further testing to confirm the completeness of the reduction.

Among the RR agents tested, the results show that DTT and Dithionite was very effective in carrying out the reduction of Cr(VI) to completion as shown by the IC results and the color changes. However, DEDTC was only able to reduce Cr(VI) partially (about 20%) in the time allowed and dose provided.

However, the RR agent formulation needs to be further evaluated to improve compatibility and the efficiency of the reducing reaction. For example, the solubility of the chromate compound in the solvent needs to be improved. Possibly, a chelating agent can be used to increase solubility of Cr(VI) by forming a soluble "metal chelate" complex with the counter ion to the Cr(VI), such as Ba, Sr and Ca.

Example 3

This example examined the effect of a chelating agent on the solubility of $SrCrO_4$ and on the reducing efficiency of the RR agents. The chelating agent tested was ethylenediamine tetra-acetic acid, $(CH_2COOH)_2NCH_2CH_2N(CH_2COOH)_2$ (also called "EDTA"). The RR agents tested were DTT and dithionite. NaOH was used to adjust the pH of the chelating agent solution.

Procedure:

1. Prepared 0.1 M EDTA: Added 10.4 ml MEK saturated HPDI water to 375 mg EDTA. Then, added 175 μl of 10M NaOH to the mixture and mixed for about 15 minutes.
2. Prepared a solution of $SrCrO_4$ in the 0.1 M EDTA solution of step 1 ($SrCrO_4$/EDTA solution): Added 6.0 ml of 0.1 M EDTA of step 1 to 24.5 mg $SrCrO_4$. All $SrCrO_4$ solids found to be dissolved within a few minutes, resulting in a bright yellow solution with no visible solid present.
3. Addition of DTT: Added about 280 mg DTT to the $SrCrO_4$/EDTA solution prepared in step 2. Within seconds of the addition, a color transformation occurred: Yellow→Orange→Brown→Dark Green→Dark Green/Blue (aqua). The entire color transformation process lasted approximately 5 minutes with the final color being dark green/blue (aqua). Dark green/blue (aqua) being the classic color of Cr(III) aquo ion, $Cr(H_2O)_6^{3+}$
4. Addition of Dithionite: Added 291 mg dithionite to 5.6 ml of the $SrCrO_4$/EDTA solution. Within 30 seconds, a color transformation began, which proceeded as follows: Yellow→Green→Dark Green→Green/Blue→Blue. The entire color changing process lasted about 3 minutes with the final color being blue.

Conclusion:

The results show that the addition of the chelating agent, EDTA, was able to enhance the dissolution of $SrCrO_4$, and possibly also assist in reducing Cr(VI) to harmless Cr(III). As such, the chelating agents such as EDTA can be considered as both the RR agents and the chelating agents. The addition of NaOH to the EDTA solution might optional.

More importantly, based on the visual observation of color changes, the addition of EDTA does not decrease the reducing efficiency of the RR agent. In addition, the presence of EDTA does not affect the color changes associated with the various stages of the Cr(VI) reduction. While not wishing to be bound by theory, it is presently believed that Cr(III) complexes caused by the present invention might have a blue/green color, and as more and more Cr(VI) was reduced to Cr(III), the color slowly changed to blue/green color.

This discovery of the efficacious effect of chelating agents leads us to theorize that other chelating agents would also be effective. It is also possible that such chelating agents would enhance the solubility of other alkaline earth salts of chromium(VI) and dichromate than just those of Sr, Mg, Ca, and Ba salts, for example $BaCrO_4$, $CaCrO_4$, $CaCr_2O_7$, and the other similar alkaline earth salts. Examples of such effective chelating agents, including the variable degrees of protonation well known to such compounds, and water and oil soluble metal ion chelating compounds, alone or blended, include, but are not limited to the following:

- Aminocarboxylates, most preferable of denticity 4 through 7 (NTA (nitrilotriacetic acid, $N(CH_2COOH)_3$), EDTA, DTPA (di(ethylene)triamine N,N,N',N",N" pentaacetic acid);
- oxalic acid and its salts;
- pyrophosphates, di(2-ethylhexyl phosphoric acid and its salts), phosphoric acid, and other phosphates'
- organo phosphonates of the formula $RPO_3H_2$;
- organo phophinic acids of the formula $R_2PO_2H$, where R is any combination of alkyl, aryl, alkylaryl, and the like. R can contain additional groups provided these groups do not adversely affect the metal ion chelating capability of the compound to complex the metal ion ("chelating ligand");
- chelating carboxcylic acids and their salts, for example citric acid, malonic acid, tartaric acid, glycolic acid, pyruvic acid, other similar acids, and their salts.

The above RR agents and chelating compounds can be provided in liquid, solution or solid form. Further, they can be added separately or pre-blended into formulated products and cleaners, or any combination of these.

Example 4

This example examined further the effect of EDTA on the solubility of $SrCrO_4$ and on the reducing efficiency of the RR agents (DTT and dithionite).

Procedure:

1. 0.1M EDTA Preparation: Added 15 ml MEK saturated HPDI water to 556.3 mg EDTA. Then, added 270 μl of 10M NaOH to the mixture and mixed for about 15 minutes.
2. 0.3M DTT: Added 281 mg DTT to 6.0 ml 0.1M EDTA and mixed for a few minutes. Then added 24.6 mg $SrCrO_4$ to the DTT/EDTA mixture. $SrCrO_4$ appeared to dissolve completely. Color transformation was only slightly less rapid than that of Example 3, which can be interpreted to suggest that $SrCrO_4$ needed to be dissolved first before reacting with the RR agent.
3. 0.3M Dithionite: Added 291 mg dithionite to 5.6 ml 0.1M EDTA and mixed for a few minutes. Then added 22.7 mg $SrCrO_4$. $SrCrO_4$ appeared to dissolve completely. Color transformation was slightly less rapid than that of Example 3, perhaps because, in Example 3, dithionite reacted directly with the dissolved Cr(VI), while in the present example, $SrCrO_4$ needed to dissolve first before reacting with the RR agent.

Conclusion:

The results (color change) show that EDTA is very effective in dissolving $SrCrO_4$ in the solvent without affecting the reducing efficiency of the RR agent.

$SrCrO_4$ does not need to be pre-dissolved in EDTA, which makes the formulation of the present invention a simpler, time saving, and cost effective formulation for Cr(VI) reduction, especially in view of the accompanying color indication for reaction stages. Preferably, in the presence of EDTA, the dissolution and the reduction of $SrCrO_4$ can be done almost simultaneously, or most preferably, in a one-step process.

Example 5

This example examined the effect of the Cr(VI) reducing formulations, using EDTA of 0.1 M, on the powdered primer containing $SrCrO_4$. The two RR agents were dithiothreitol (DTT) and dithionite. Similar to the previous examples, the amount of the RR agent was about 10× the molar amount of Cr(VI) in the primer powder, and the amount of EDTA was about 5× the molar amount of strontium in the primer powder.

The primer coating was scraped off of five aluminum panels by using a flat-sided spatula into a plastic weigh boat. The scraped-off primer was milled to a fine powder (<60 mesh) prior to use. The primer was MIL-PFPF-233773 made by Deft. Per the MSDS, and this primer contained about 19% $SrCrO_4$. The aluminum panels were primer coated aluminums cut to the dimension of hand-sized coupons.

Procedure:

1. 0.1M EDTA: Mixed 3.7605 g EDTA, 100 ml MEK saturated HPDI water, and 0.5152 g NaOH together for about 2 hours. The final solution had 0.100M EDTA, 0.126M NaOH, and pH of 8.5. NaOH neutralized the acidic EDTA to provide a mild pH formulation. MEK was partially separated out initially, and therefore, the bottle was mixed thoroughly just prior to use so as to prevent the separation of MEK.
2. 0.3M Dithiothreitol (DTT) in 0.1M EDTA: Added 0.472 g DTT to 10.0 ml of 0.1M EDTA prepared in step 1.
3. 0.3M dithionite in 0.1M EDTA: Added 0.5215 g dithionite to 10.0 ml of 0.1M EDTA prepared in step 1.
4. Added the DTT reducing agent solution (step 2), the dithionite reducing agent solution (step 3), or the EDTA solution with no reducing agent (control) to a 100 mg portion of the primer powder according to the formulations as provided in Table 5.
5. Vortexed the samples for about 1 minute using a Thermolyne Maxi Mix II vortex.
6. Sonicated the samples for about 10 minutes using a Branson ultrasonic bath, Model 5510.
7. Tumbled end-over-end for about 24 hours using a rotary inversion mixer at 1 to 1.5 cycles per second.
8. Centrifuged the samples at about 2500 rpm for 15 minutes to separate the mixtures into solid/liquid phases.
9. Filtered the liquid phases using a 0.2 μm PTFE membrane, and then transferred the filtrate into a separate vial.
10. Rinsed the solid materials twice using 550 μl HPDI water for each rinse. Centrifuged the resulting liquid, and filtered the liquid. Then, added the liquid rinse into the liquid phases of step 9. Analyzed the liquid phases (also called supernatants) using the IC system of Example 2.
11. Dried the rinsed solid materials by nitrogen evaporation in a 35° C. water bath. Analyzed the solid material (Solid Composite) for Cr(VI) using an Ion Chromatography system and Mod. OSHA ID-215 method with the level of quantification being 0.0030 μg. Visual observations of color change are noted in Table 6.

TABLE 5

RR Agent with EDTA formulations

| Samples | Primer (mg) | RR agent | Solvent | Comment |
|---|---|---|---|---|
| Control 1 | 100.1 | — | — | Primer only |
| Control 2 | 100.1 | — | 4.9 ml 0.1M EDTA | Primer + 0.1M EDTA (no RA) |
| DTT | 100.5 | 0.3M DTT | 4.9 ml 0.1M EDTA | Primer + DTT in EDTA |
| Dithionite | 100.3 | 0.3M Dithionite | 4.9 ml 0.1M EDTA | Primer + Dithionite in EDTA |

TABLE 6

| Color Observation of the Formulations in Table 5 | | | | |
|---|---|---|---|---|
| Samples | Upon addition of liquid to primer | After ~3 hours of tumbling | After ~24 hours of tumbling | |
| Control 2 | Bright yellow | Bright yellow | Liquid: Solid | Bright yellow Yellow |
| DTT | Bright yellow → brown (within 1 min) | Dark green | Liquid Solid | Dark green/blue Light blue/gray |
| Dithionite | Bright yellow → purple (within 1 min) | Dark blue/purple | Liquid Solid | Purple Slightly yellow |

Results:

Initial IC analysis of the supernatants showed that no chromate was present, indicating complete reduction of chromate in the primer powder. The resulting supernatants were then diluted and spiked with a Cr(VI) standard solution to a concentration of about 500 ppm Cr(VI). When these samples were assayed, Cr(VI) was observed in the IC analysis of the spiked supernatants, but at much lower levels than what would be expected for 500 ppm Cr(VI). So it was theorized that the RA solutions likely still have additional reduction capabilities even after reacting with the Cr(VI) in the powdered primer, which was expected because the RR agent was present in 10× molar excess to Cr(VI) in the primer powder.

Table 7 shows the results of the IC analysis for the supernatants and the solid composites of the samples respectively.

In the case of the DTT reducing solution, it was able to reduce Cr(VI) completely. The results show that DTT can assist the solvent in extracting Cr(VI) from the primer coating as well as the reduction of Cr(VI) to Cr(III).

Further, the post-spiking test results show that additional Cr(VI) reductions were found for both DTT and Dithionite supernatants after reacting with Cr(VI) in the primer coating. This demonstrates that the true capacities of the formulations in this example are greater than what had been shown.

Example 6

This example evaluated the ability of the RR agents in a 0.2 M EDTA solution to penetrate and reduce Cr(VI) in primer coated aluminum alloy panels. The primer panel was a coupon-size aluminum substrate with an unaged (newly deposited) primer coating, and the primer coating was MIL-PRF-233773 primer coating. The tested RR agents were dithiothreitol (DTT) and dithionite. No IC analysis was done on the panels.

Procedure:

1. 0.2 M EDTA Solution: Added 15.0491 g EDTA and 2.0082 g NaOH to 150 ml 25% IPA in HPDI water. Stirred for ~18 hours to dissolve EDTA, and then diluted it to 200 ml with 25% IPA/HPDI water. The resulting mixture had a pH of about 8.5.
2. 0.5 M DTT Solution: Added 2.3374 g DTT to 30 ml of the 0.2 M EDTA solution.
3. 0.5 M Dithionite Solution: Added 2.6122 g Dithionite to 30 ml of 0.2 M EDTA of step 1.
4. Placed 2"×2" aluminum panels coated with Cr(VI) primer into individual petri dishes, and then applied either 2.2 ml of the 0.5M DTT solution or 2.2 ml of 0.5M Dithionite solution directly onto the primer coating on the aluminum panels.
5. Covered the petri dishes and allowed to sit for ~24 hours.
6. Removed the supernatants from the petri dishes.
7. Rinsed the aluminum panels twice with 900 μl of HPDI water for each rinse, and then dried the rinsed panels.

Results:

For DTT, some color changes were observed for the supernatant, indicating that DTT reduced some Cr(VI). However, the primer coating was still intact with the original yellow color after soaking the panel for about 24 hours in the DTT solution. While not wishing to be bound by theory, it is presently believed that DTT was only able to reduce Cr(VI) on the surface of the primer and was not able to penetrate the primer coating. Much longer soaking time and/or increased soaking temperatures can be used to speed diffusion so that more complete Cr(VI) reduction can be achieved.

For dithionite, no color change was observed. However, a significant amount of precipitation was observed, indicating that Cr(VI) might have been reduced and then precipitated as the sulfide, such as a solid precipitate of formula $Cr_2S_3$ or the like. It is well known in the art that solutions of dithionite

TABLE 7

| Solid Composite Analysis | | | | | | | |
|---|---|---|---|---|---|---|---|
| Samples | Amt. Cr(VI) in solid (mg) | Amt. Cr(VI) in liquid (mg) | Total Amt. of Cr(VI)* (mg) | % reduced | % Cr(VI) in Primer* | % $SrCrO_4$ in primer | Extraction Efficiency (%) |
| Control 1 | 3.90 | NA | 3.90 | NA | 4.5 | 17.6 | — |
| Control 2 | 0.680 | 3.48 | 4.16 | NA | — | — | 84 |
| DTT | 0.00078 | <0.006 | <0.00678 | >99.8 | — | — | — |
| Dithionite | 0.600 | <0.006 | <0.606 | 84.5 | — | — | — |

*The primer contained 17.6% $SrCrO_4$ as determined from the IC analysis.

Conclusion:

The results from Table 7 show that DTT was the most effective in reducing Cr(VI) in the primer while dithionite was still effective. This result is consistent with the color changes listed in Table 6, demonstrating that the color changes can be a signpost for the effectiveness of the Cr(VI) reduction (see Table 6). All systems reacted fast enough to be commercially applicable for processes such as surface finishing of aircraft coatings, painted ship surfaces, part surfaces, and other similar operations.

In this example, dithionite did not reduce all Cr(VI) in the primer, but the incomplete reduction might be attributable to the fact that the extraction efficiency of the EDTA/solvent solution was only about 84%. Even though the Cr(VI) was not completely reduced, the leftover dithionite solution still had significant reducing capability as shown by the spiking test of the resultant supernatants. It was possible that the $Cr^{3+}$ ions generated by the reduction of $Cr^{6+}$ competed with $Sr^{2+}$ ions for EDTA (the chelating agent) in forming complexes, thereby limiting the chelating agent's ability to completely extract (or dissolve) $SrCrO_4$ from the primer. A higher concentration of EDTA or additional EDTA being added later in the process are recommended to facilitate sufficient extraction to enable full reduction of Cr(VI) when dithionite or other similar compounds are used as the RR agents.

and related thio-based solutions are unstable and slowly decompose to elemental sulfur and other products over periods of days and weeks. This does not prevent the use of these compounds for the present invention, though it does suggest that the preferred formulation be a solid form if thio compounds are to be used. Of course, the non-thio AA agents can be used.

Further, the primer coating also appeared to be unchanged, suggesting that dithionite in water was unable to penetrate the primer coating.

Other RR agents, increasing concentration of chelating agents, or other additives should be evaluated to increase the penetration into the primer coating. For example, to penetrate such primer and topcoat coatings, the RR agent(s) and chelating agent(s) can be formulated with oil-penetrating liquids, or such coatings can be loosened first by scribing, ultrasonic, thermally, gas absorption, or combinations of these techniques. Increasing concentration of chelating agents, or other additives can also be used to increase the penetration into the primer coating. Oil soluble chelating thio reagents can be used with oil soluble alkaline earth complexing agents.

Moreover, hydroxylamine, hydrogen sulfide ion, and mildly acidic hydrogen peroxide are suitable examples of very small molecule reducing agents that could be formulated, preferably with penetrating fluids and oils, to penetrate top coats and primers.

Example 7

This example evaluated the effectiveness of sodium ascorbate on reducing Cr(VI) in $SrCrO_4$.

Procedure:

0.2 M EDTA was prepared as shown in Example 6. 0.3M sodium ascorbate in 0.2 M EDTA (ascorbate/EDTA solution) was prepared by adding 0.2985 g sodium ascorbate to 5.0 ml of 0.2 M EDTA and sonicating for 2 minutes. Sodium ascorbate dissolved completely to produce a colorless clear solution with a pH of about 8.5. No additional NaOH was used.

Added the resulting ascorbate/EDTA solution to 22.9 mg of pure $SrCrO_4$ powder. The ascorbate/EDTA solution contained about 10× molar excess of ascorbate and EDTA to the amount of Cr(VI) and Sr(II) respectively.

All $SrCrO_4$ power was dissolved. Color changes were observed within two minutes:

Bright yellow→green→dark green→emerald green

After about 24 hours, the solution was brown/purple.

Conclusion:

The color observation shows that sodium ascorbate was very effective in reducing Cr(VI) in $SrCrO_4$. More studies are needed to evaluate the reducing efficiency of sodium ascorbate over time. It is interesting to note that ascorbate also acted as a chelating agent in the present example, and thus ascorbate can provide the dual function of being an RR agent and a chelating agent.

Example 8

This example evaluated the effectiveness of sodium ascorbate on reducing the dissolved Cr(VI) over time. The negative control is 0.144 M sodium ascorbate; the positive control is 1.5 ml 25% IPA/$H_2O$ spiked with the 52 mg/ml Cr(VI) stock to 500 ppm Cr(VI). The source of Cr(VI) used for testing was sodium dichromate dihydrate ($Na_2Cr_2O_7 \cdot 2H_2O$).

Similar to the previous examples, the RR agent was at a 10-fold molar excess in comparison to that of Cr(VI).

Procedure:

A Cr(VI) stock solution was prepared first. The RR agent (such as sodium ascorbate) was dissolved in the appropriate solvent, and then an appropriate amount of the Cr(VI) stock solution was added just prior to injection into the Ion Chromatography (IC) system (within approximately 1 minute). Sequential injections were made by the IC system at regular intervals over a period of about 16 hours to evaluate reduction efficiency of sodium ascorbate over time.

1. Cr(VI) stock solution: Dissolved 0.7475 g sodium dichromate dihydrate in 4.7 ml HPDI water to produce 52 mg/ml Cr(VI) stock. Diluted 192 μl of the 52 mg/ml Cr(VI) stock solution with 808 μl HPDI water to obtain 9.98 mg/ml Cr(VI) stock. 500 ppm Cr(VI) was prepared from this 9.98 mg/ml Cr(VI) stock by dissolving 50 μl Cr(VI) stock in 950 μl HPDI water.
2. 0.144 M sodium ascorbate: Dissolved 0.1441 g sodium ascorbate in 5.0 ml 25% IPA/HPDI water. A portion of this solution was used as a negative control. The other portion was spiked with the Cr(VI) stock as shown below.
3. Ascorbate/Cr(VI) solution: To 1.5 ml of 0.144 M sodium ascorbate, added 14.4 μl of 52 mg/ml Cr(VI) stock and vortexed for about 10 seconds by using a Thermolyne Maxi Mix II vortex mixer.
4. The positive control was a portion of the solvent (25% IPA/HPDI water) with no RR agent that was spiked in the same manner as the ascorbate solution in step 3.
5. The samples were tested for Cr(VI) by using the IC system described in Example 2.

Results:

The ascorbate/Cr(VI) solution changed color from yellow to green immediately. After sitting the solution overnight, the color became brown.

The analytical results show that about 70% of Cr(VI) was reduced before the first injection into the IC system (less than 1 minute). At about 0.6 hours after adding the Cr(VI) to the ascorbate solution, 99% Cr(VI) was removed. After 9 hours, 99.9% Cr(VI) was removed.

Ascorbate/EDTA solution was shown to be effective in reducing Cr(VI) in the Cr(VI) solution. Further, this solution did not produce any undesirable pungent odor.

Example 9

The example evaluated the effectiveness of sodium hypophosphite in 0.2 M EDTA on reducing Cr(VI) in $SrCrO_4$.

Procedure:

0.2 M EDTA was prepared as shown in Example 6. 0.3M sodium hypophosphite in 0.2 M EDTA (hypophosphite/EDTA solution) was prepared by adding 0.1599 g sodium hypophosphite to 5.0 ml of 0.2 M EDTA and sonicating for 2 minutes. Sodium hypophosphite dissolved completely to produce a colorless clear solution with a pH of about 8.5.

Added the resulting hypophosphite/EDTA solution to 21.2 mg of pure $SrCrO_4$ powder. The hypophosphite/EDTA solution contained about 10× molar excess of hypophosphite and EDTA to the amount of Cr(VI) and Sr(II) respectively.

Results:

All $SrCrO_4$ powder was dissolved. No color change was observed after about 24 hours, indicating that hypophosphite as formulated was not an effective RR agent for Cr(VI). Lower pH to about 3-5 and/or incorporating a phosphite ester chelating agent (Cyanex® 272 or small carbon number chelant) might improve hypophosphite's reactivity toward Cr(VI). The lowering of pH converts Cr(VI) ion, $CrO_4^{=}$, to the much more aggressively reacting bichromium(VI) ion, $HCrO_4^{-}$.

Example 10

The example evaluated the ability of ascorbate to reduce Cr(VI) to Cr(III) for Cr(VI) in a chromate-containing primer powder.

The primer was scraped off of five (5) aluminum panels (coupon size) using a flat-sided spatula and was collected into a plastic weigh boat. The primer coating was MIL-PRF-23377J made by DEFT (ID No. 01-Y-040), which contains approximately 19% $SrCrO_4$. The primer was milled to a fine powder prior to use. The control was the mixture of primer in 0.2 M EDTA.

Procedure:

1. 0.2 M EDTA was prepared as shown in Example 6.
2. 0.3 M sodium ascorbate in 0.2 M EDTA (ascorbate/EDTA solution) was prepared by adding 0.2994 g sodium ascorbate to 5.0 ml of 0.2 M EDTA and sonicating for 2 minutes.
3. Added 3.9 ml of the resulting ascorbate/EDTA solution to about 80.5 mg of the milled primer powder. The ascorbate/EDTA solution contained about 10× molar excess ascorbate and EDTA to the amount of Cr(VI) and Sr(II) respectively.
4. Vortexed the samples for about 1 minute using a Thermolyne Maxi Mix II vortex mixer.
5. Sonicated the samples for about 10 minutes using a Branson ultrasonic bath, model 5510.
6. Tumbled end-over-end for about 24 hours using a rotary inversion mixer at 1 to 1.5 cycles per second.
7. Centrifuged the samples at about 2500 rpm for 15 minutes to separate the mixtures into solid/liquid phases.
8. Filtered the liquid phases using a 0.2 μm PTFE membrane, and then transferred the phase into a separate vial.
9. Rinsed the solid materials twice using 450 μl HPDI water for each rinse. Centrifuged the resulting liquid, and filtered the liquid. Then, added the liquid rinses into the liquid phases of step 8. Analyzed the liquid phases (also called supernatants) using the IC system of Example 2.
10. Dried the rinsed solid materials by nitrogen evaporation in a~35° C. water bath. Analyzed the solid material (Solid Composite) for Cr(VI) using an Ion Chromatography system and Mod. OSHA ID-215 method with the level of quantification being 0.0030 μg.

Control 1 was a milled primer powder with no solution added. Control 2 was a milled primer powder with the 0.2 M EDTA solution added (without any RR agent).

Results:

The color of the control solutions remained bright yellow, while the ascorbate solution changed from yellow to green upon addition, and then to blue green after half hour. After 24 hours, the control solutions remained yellow, the supernatant of the ascorbate sample changed to dark brown. The solid remains of the ascorbate sample after 24 hours showed a white/tan color, which was the same as that of the controls.

The color changes indicate that ascorbate was very effective at reducing Cr(VI) to Cr(III) in the primer powder. In fact, it was as effective as that of DTT or that of dithionite (as shown in Example 6) without producing any undesirable odor, such as sulfur odor.

The results from the color change were confirmed by the analytical results for the solid composites in Table 8. Further, the results in Table 8 show that a much higher Cr(VI) extraction efficiency was achieved (98.4%) than that in Example 6 (84%) where only a 5× molar excess of EDTA was used. While not wishing to be bound by theory, it is presently believed that the higher concentration of EDTA in this formulation (0.2 M) as compared to 0.1 M EDTA used in Example 6 led to the increase in extraction efficiency.

TABLE 8

Solid Composite Analysis

| Samples | Amt. Cr(VI) in solid (mg) | Amt Cr(VI) in liquid (mg) | Total Amt. of Cr(VI)* (mg) | % reduced | % Cr(VI) in Primer* | % $SrCrO_4$ in primer | Extraction Efficiency (%) |
|---|---|---|---|---|---|---|---|
| Control 1 | 2700 | NA | 3.90 | NA | 5.1 | 20.1 | — |
| Control 2 | 56 | 3.542 | 3.60 | NA | — | — | 98.4 |
| Ascorbate | 2 | <0.012** | <0.014 | >99.6 | — | — | — |

*The primer contained 19.13% $SrCrO_4$ as determined from the IC analysis.

**Cr(VI) was not detected in this sample. Detection limit was 0.5 ppm for this method.

Conclusion:

In sum, both visual observation of color changes and the analytical results demonstrate that ascorbate was very effective at reducing Cr(VI) to Cr(III) in the primer powder without producing any undesirable odor. Such odors might become hazardous to works if present in an open shop operation. Therefore, non-odorous ascorbate formulation might have broader applications than thio-based formulations tested in the previous examples.

In addition, while not wishing to be bound by theory, it is presently believed that the higher concentration of EDTA in this formulation (0.2 M) as compared to 0.1 M EDTA used in Example 6 led to the increase in extraction efficiency.

More importantly, the distinct color change associated with the Cr(VI) reduction using the present formulation can be an easy tool to use to identify the completion of the Cr(VI) reduction without any further time consuming, potentially costly testing. Further, this color indication can reduce the operators' exposure to Cr(VI) dusts.

Example 11

This example evaluated the ability of various carriers to swell, delaminate, and/or digest the primer coating. The aluminum panels (in coupon size) were low carbon aluminum coated with MIL-PRF-233773 Deft chromated primer without topcoat.

Procedure:

1. Each solvent/stripper as listed in Table 9 was placed into a petri dish. One panel was placed in the petri dish so that it was covered by the respective solvent/stripper. Then, the petri dishes were covered, and the panels were allowed to sit in the solvent/stripper overnight. No RR agent was used. Observations were made as to the effectiveness of each solvent/stripper to swell, delaminate, and/or digest the primer coating on the panel.

Lift Off® is a commercial paint stripper with its main ingredients being kept as trade secret, containing <10% acetone. Goo Gone® Pro Power includes petroleum distillates, citrus extracts, and tripropylene glycol methyl ether. GOJO Orange Pumice includes petroleum distillates, propylene glycol, and D-limonene. Both Goo Gone® and GOJO are terpene-based cleaners.

TABLE 9

| Solvent/Stripper Compounds | | |
|---|---|---|
| Solvent/Stripper | Description | Observation |
| MEK | Pure solvent | No reaction |
| 50:50 MEK/Toluene | Pure solvent mixture | No reaction |
| Benzyl Alcohol (BnOH) | Pure solvent | Delamination around edges of the panel (about 5%) |
| PolyGone 310-AG | Polysulfide digester | No reaction |
| Diglyme | Bis(2-methoxyethyl) ether | No reaction |
| N-methyl pyrrolidinone (NMP) | Pure solvent | Delamination around edges of the panel (about 10%) |
| Lift Off ®* | Commercially available paint stripper | Full delamination (100%). Some rusts observed on substrate. |
| Goo Gone ® Pro Power | Commercially available cleaner, degreaser, and adhesive remover-orange terpine based | No reaction |
| GOJO Orange Pumice | Commercially-available hand cleaner-orange terpine based | No reaction |
| Formic Acid | Pure HCOOH, pH ~1-2 | Coating bubbled and delaminated completely within 20 seconds. Color changed from yellow to brown. No immediate rust formation on substrate within a couple minutes. |
| Acidified Benzyl Alcohol | ~6% Formic acid in BnOH | Full delamination (100%) with no change in primer color and no rust formation on the substrate |
| Alkaline Benzyl Alcohol | ~8% Diethylamine in BnOH | No reaction |

*Lift Off ® was manufactured by Motsenbocker's. It is an aqueous-based, biodegradable paint remover made to strip spray paint, primer etc.

2. Added each of the RR agent (sodium ascorbate and DTT) solutions to the delaminated primer film from the formic acid (HCOOH) test:
   a. Placed the delaminated primer coating from the formic acid test into two separate vials.
   b. Added a few ml of HCOOH, a few ml of sodium ascorbate, and about 1 ml of 0.2 M EDTA into one vial. Allowed to sit overnight. After about 18 hours, the color of the supernatant changed to a purple color, and the solid changed to a grayish color.
   c. Added some volume of acetone, and some volume of 0.5M DTT/0.2M EDTA solution to the second vial. Allowed to sit overnight. After about 18 hours, the color of the supernatant changed to a purple color, and the solid changed to a grayish color.

Conclusion:

NMP, Benzyl alcohol, Lift Off®, and formic acid all showed some degrees of delaminating the primer coating. NMP and benzyl alcohol's effectiveness in delaminating the primer coating were shown to be minimum. Therefore, these strippers may be preferred when the formulation does not require any lifting off or delamination of the primer coating, but requires swelling the matrix of the primer coating to enable penetration of the RR agent. Delamination and/or lifting off of primer coating, in some instances, might present some safety concerns to the workers doing the re-surface finishing and painting production.

The most effective carriers appeared to be Lift Off® and formic acid, both of which caused full delamination of the primer coating. Lift Off® showed to be very effective at delaminating the primer coating, but it produced an unacceptable side effect of corroding the substrate (the rust appearing on the stainless aluminum substrate). This side effect can be reduced if it is diluted somewhat with one or more weaker strippers, such as benzyl alcohol or NMP.

Formic acid was the most effective at full and quick delamination of the primer coating. In a subsequent testing to identify the percentage of formic acid to enable sufficient coating penetration, an about 6% formic acid addition to the benzyl alcohol was tested and found to be able to increase delamination capacity to 100% from about 10% from the pure benzyl alcohol. Further studies can be done to study the efficacy and safety issues associated with formic acid. It is also desirable to prevent premature removal of the coating by the formic acid because removing the coating prior to the full reduction of Cr(VI) to Cr(III) can create safety issues. Therefore, it is preferred to reduce Cr(VI) prior to the stripping of the coating.

Based on the color changes associated in the subsequent testing of the delaminated primer coating by the formic acid, both RR agents (ascorbate and DTT) appeared to reduce Cr(VI) considerably in the HCOOH delaminated primer coating. It appears that HCOOH lowered the pH sufficiently to enhance the reduction capabilities of the RR agents. In addition, at the lower pH environment provided by HCOOH, the much more reactive $HCrO_4^-$ species was generated so as to enable the reduction of Cr(VI) in the delaminated primer coating. Further, while not wishing to be bound by theory, it is presently believed that the increased surface area of the delaminated primer coating in comparison to the intact primer coating might also assist this increased reduction efficiency.

Example 12

This example evaluated the Cr(VI) reducing efficiencies of ascorbate and DTT in the wet-wipe application of the Cr(VI) primer coating.

Procedure:

1. 0.5 M sodium ascorbate in 0.2 M EDTA: 0.5084 g sodium ascorbate in 5.0 ml of 0.2 M EDTA in 25% IPA/$H_2O$.
2. 0.5 M dithiothreitol (DTT) in 0.2 M EDTA: 2.3374 g DTT diluted to 30 ml with 0.2 M EDTA in 25% IPA/$H_2O$.
3. Control: 0.2 M EDTA in 25% IPA/$H_2O$.
4. Wetted a cotton wipe with each of RR agent solutions or the control.

5. Sanded a small amount of primer powder off an unaged, non-topcoated aluminum panel over a glass petri dish so as to collect the sanded primer powder in the petri dish.
6. Used each of the wet wipes to wipe off the primer powder off the petri dish, and observed the color changes over time.

Results:

Ascorbate: All primer powder was collected by the wet wipe with ascorbate. The primer collected on the wipe changed color from yellow to green in about 30 to 60 seconds.

DTT: All powder was collected by the wet wipe with DTT. The primer collected on the wipe changed color from yellow to brown within 20 seconds.

Control: All powder was collected by the wet wipe with control. No color change was observed.

Conclusion:

Ascorbate and DTT were shown to be very effective in reducing Cr(VI) in the sanded primer powder when used in the wet-wipe application.

Example 13

This example evaluated the effectiveness of the RR agents in reducing Cr(VI) during the process of wet sanding the Cr(VI) containing primer coating. The RR agents were 0.5 M sodium ascorbate and 0.5M DTT as prepared in Example 12. The control was 0.2 M EDTA in 25 v/v % IPA/$H_2O$.

Several drops of each of the three solutions (ascorbate, DTT, and control) were added to each unaged, primer coated aluminum coupon-size panel (no topcoat). Then, the aluminum panels were sanded by using 100-grit sand paper.

Observation:

Ascorbate: During sanding, a yellow solution formed, which then changed into a green paste within about 60 seconds.

DTT: During sanding, a brown solution formed, and then changed into a brown paste within about 60 seconds.

Control: During sanding, a yellow solution was formed, which changed into a paste while the yellow color remained unchanged.

Substrate: In all three cases, the substrates appeared unaffected by any of the RR agents or the control.

Conclusion:

The RR agents were shown to be effective in reducing Cr(VI) during the wet sanding process. Further, they did not appear to affect the aluminum substrate. Therefore, the RR agents, DTT and ascorbate, might be considered efficacious and safe to be used on the aluminum equipment, and likely steel equipment during the wet sanding operation or application. The strength of the formulation might be varied to match the range of metal alloys substrate so that the formulation would not degrade the metal surface while still provide the Cr(VI) reduction benefit during the fast wiping action.

Example 14

This example explores the compatibilities of various concentrations of the RR agents in a new solvent (carrier system), Lift Off®. The RR agents were sodium ascorbate (ascorbate) and ascorbic acid. Lift Off® is a commercially available paint stripper with its main ingredients being trade secret.

Procedure 1. 0.3 M Sodium Ascorbate/0.2 M Disodium EDTA in Lift Off®:
   a. Added 0.75 g disodium EDTA to 10 ml Lift Off®, and mixed for a few minutes. The disodium EDTA was insoluble so 5 ml of a 10% NaOH solution was added. Disodium EDTA then dissolved completely; however, the organic component of Lift Off® remained separate from the aqueous phase.
   b. Added 0.6 g sodium ascorbate to the mixture of the previous step. Ascorbate dissolved immediately, resulting in a yellow colored liquid mixture. However, the organic phase was still separate from the aqueous phase.
   c. Added 2 ml isopropyl alcohol (IPA), and mixed for a few minutes. It was found that the organic phase was still immiscible.
   d. Added 10 μl of diglyme (bis(2-methoxyethyl) ether), and mixed for a few minutes. The organic phase was still immiscible. A higher amount of diglyme can be used, such as ⅓ to ⅔ of the total volume.
2. 0.3 M Sodium Ascorbate/0.2 M Disodium EDTA in Lift Off®
   a. Added 1 g disodium EDTA to 10.5 ml Lift Off®. Found disodium EDTA to be insoluble in Lift Off®.
   b. Added about 1.6 ml of 10% NaOH. Disodium EDTA dissolved in the resulting solution.
   c. Added 0.6 g sodium ascorbate, and mixed for a few minutes until the ascorbate solids dissolved. The resulting solution had a pH of about 9.
3. 0.5 M Sodium Ascorbate in Lift Off®:
   a. Added 1 g sodium ascorbate to 10 ml Lift Off®, and mixed for a few minutes. All ascorbate solids dissolved, but the organic phase separated out. The resulting mixture had a pH of about 6.
4. 0.3 M Ascorbic Acid and 0.2 M tetrasodium EDTA in Lift Off®:
   a. Added 0.8 g tetrasodium EDTA to 10 ml Lift Off®, and mixed for a few minutes. The tetrasodium EDTA dissolved in Lift Off®, but the organic phase remained separated.
   b. Added 0.5 g ascorbic acid to the step a mixture. All solids dissolved; the resulting solution had a pH of about 5-6.

Conclusion:

The observation shows that the addition of NaOH increased the solubility or compatibility of EDTA in Lift Off®. Even more importantly, the use of tetrasodium EDTA instead of disodium EDTA increased the solubility of EDTA and/or sodium ascorbate in Lift Off® without the addition of NaOH. As such, the use of tetrasodium EDTA increases the compatibility without any additional ingredients, simplifying the process greatly.

In addition, it is interesting to note that the addition of ascorbic acid instead of sodium ascorbate lowered the pH of the resulting solution from 8.5 to about 5.5.

Example 15

This example evaluated the effect of the ascorbate/tetrasodium EDTA, ascorbic acid/tetrasodium EDTA, and DTT/tetrasodium EDTA on the Cr(VI) in the intact primer coating. The intact primer coatings were on the primer coated aluminum panels (in coupon size). The primer was an unaged Cr(VI) containing primer, #MIL-PRF-23377. The RR agents were sodium ascorbate, ascorbic acid, and DTT. The chelating agent was tetrasodium EDTA.

Procedures:

1. 0.3 M Sodium Ascorbate/0.2 M EDTA in Lift Off®: Added 1.2 g sodium ascorbate and 1.6 g tetrasodium EDTA to 20 ml Lift Off®. Mixed for a few minutes until all solids were dissolved. The resulting solution had a pH of about 8-9.
2. 0.3 M Ascorbic Acid/0.2 M EDTA in Lift Off®: Added 1.1 g ascorbic acid and 1.6 g tetrasodium EDTA to 20 ml Lift Off®. Mixed for a few minutes until all solids were dissolved. The resulting solution had a pH of about 5-6.

3. 0.3 M DTT/0.2 M EDTA in Lift Off®: Added 0.9 g DTT and 1.6 g tetrasodium EDTA to 20 ml Lift Off®. Mixed for a few minutes until all solids were dissolved. The resulting solution had a pH of about 5-6.
4. Added one aluminum panel (coupon size) coated with MIL-PRF-23377 primer to each of the above three solutions. Let the panels sit overnight in the solutions.

Observation:

For all of these RR agent solutions, there appeared to be no change in the color or adhesion of the primer coating. The formulation needed to be improved to enable the RR agents to access the Cr(VI) ions within the primer coating.

Example 16

This example evaluated the effectiveness of citric acid as a RR agent and/or a chelating agent for extracting and/or reducing Cr(VI) within the primer coating of the primer coated aluminum panels cut to panel sizes. The primer was an unaged Cr(VI) containing primer, #MIL-PRF-23377.

Procedure:

1. 50 wt % citric acid: added 9.5969 g citric acid to 9.4 ml HPDI water, and mixed to dissolve citric acid. The resulting solution had a pH of about 1.
2. 25 wt % citric acid: added 5 ml of 50 wt % citric acid to 5 ml HPDI water, and mixed for a few minutes. The resulting solution had a pH of about 1.
3. 5 wt % citric acid: added 1 ml of 50 wt % citric acid to 9 ml HPDI water, and mixed for a few minutes. The resulting solution had a pH of about 2.
4. Added each of the above three solutions to a container, immersed one $SrCrO_4$ based primer coated aluminum panel in each solution. Let the panels sit in the solutions overnight.

Observation:

No visual change with any of the solutions overnight. No color change to the primer coating or to the leachate. Color change in the leachate would signify that $SrCrO_4$ was extracted from the primer coating. No observable change to the adhesion of the coating, such as delamination or bubbling of the coating.

Conclusion:

The results show that citric acid did not break down or extract $SrCrO_4$ from the primer coating as intended. Need to evaluate other suitable acids.

Example 17

This example evaluated the effect of adding HCOOH (formic acid) to the RR agents in reducing Cr(VI) within the intact primer coating. HCOOH was added to evaluate its ability to break down the polyamide structure of the MIL-PRF-23377 primer in order to allow the RR agent access to the entrained $SrCrO_4$. Formic acid is a known reducing agent, so it might also provide the added benefit of enhancing the reduction potential of the resultant formulation.

The intact primer coatings were on the primer coated aluminum panels (in coupon size). The primer was an unaged Cr(VI) containing primer, #MIL-PRF-23377.

Procedure:

1. 50 v/v % HCOOH: Mixed 4 ml HCOOH with 4 ml HPDI water.
2. 0.3 M Ascorbic Acid in 50 v/v % HCOOH: Added 0.4234 g ascorbic acid to 8 ml of the 50 v/v % HCOOH solution as prepared in step 1, and mixed for a few minutes. The resulting solution had a pH of about 1.
3. 0.3 M Sodium Ascorbate in 50 v/v % HCOOH: Added 0.5 g sodium ascorbate to 8 ml of the 50 v/v % HCOOH solution as prepared in step 1, and mixed for a few minutes. The resulting solution had a pH of about 1.
4. 0.3 M DTT in 50 v/v % HCOOH: Added 0.36 g DTT to 8 ml of the 50 v/v % HCOOH solution as prepared in step 1, and mixed for a few minutes. The resulting solution had a pH of about 1.
5. Added each of the above four solutions to a container; immersed one $SrCrO_4$ primer coated aluminum panel in each solution. Let the panels sit in the solutions overnight.
6. Added about 1 ml 50 v/v % HCOOH to a few mg of $SrCrO_4$. $SrCrO_4$ dissolved immediately in the formic acid. Normally, $SrCrO_4$ is only sparingly soluble in water without a chelating agent.
7. Added 2 drops of almost pure HCOOH to the primer coated aluminum panel.

Observation:

1. Ascorbic Acid/HCOOH solution:
   a. Within 10 minutes of putting the panel into the solution, the primer coating began to turn pale. After about 18 hours, the coating was pale gray, and the leachate turned a blue color. The aluminum substrate appeared to be unaffected by the low pH. After about 18 hours of the treatment, the primer coating was easier to scrape off (less dense and less adherent to the substrate).
   b. After about 18 hours, the leachate was withdrawn to another container, and its pH was adjusted to be greater than 7 by the addition of NaOH. The color of the leachate changed to yellow/orange/brown.
2. Sodium Ascorbate/HCOOH solution: the same as that of ascorbic acid/HCOOH solution.
3. DTT/HCOOH solution: the same as that of ascorbic acid/HCOOH solution except a small amount of gel-like precipitates fell out upon pH adjustment.
4. 50 v/v % HCOOH solution: the primer coating film turned brown. The leachate solution turned a light blue color. After about 18 hours, the pH of the leachate solution was adjusted to above 7; the color did not change much, remaining a light blue/cream color. No visual effect on the aluminum substrate was observed.
5. 50 v/v % HCOOH on pure $SrCrO_4$ powder (not in the primer): The color of the solution changed from yellow to brown after about 10 minutes and to blue green after about 18 hours.
6. 2 drops of pure, undiluted HCOOH on the primer coated aluminum panel: Within 20 seconds, the primer coating turned brown, bubbling, and was delaminated.
7. Added 2 drops of 50 v/v % HCOOH on the primer coated panel: within 60 seconds, the primer coating turned brown, bubbling, and was delaminated.

Conclusion:

The pale gray color of the coating after reacting with the combination of RR agent and HCOOH (RA/HCOOH) was similar to that observed after reacting with the combination of RR agent and EDTA (RA/EDTA) in Example 5.

The color changes indicate that the RA/HCOOH may be able to extract $SrCrO_4$ from the intact primer coating. The value of this discovery is that $SrCrO_4$ would be released into the leachate where the RR agent can chemically reduce the released Cr(VI). With this benefit, even if the released Cr(VI) was not reduced or completely reduced, just the ability to extract Cr(VI) from an intact primer coating is very desirable because other AA agents can be used to fully reduce Cr(VI).

Importantly and very unexpectedly, these results show that the present RA/HCOOH formulation did not affect the substrate base metal, even at the extreme low pH of about 1.

Further, it is found that while $SrCrO_4$ normally is only sparingly soluble in water without a chelating agent, $SrCrO_4$ immediately dissolved in 50 v/v % HCOOH solution. Therefore, the results demonstrate that decreasing pH in the solvent medium (provided by 50% HCOOH) can serve to increase the solubility of $SrCrO_4$ in an aqueous medium without any use of a chelating agent. While not wishing to be bound by theory, it is presently believed that the formic acid (in high concentrations) converts $CrO_4^{=}$ions into the far more soluble and reactive $HCrO_4^-$ ions, and thus, the resulting $Sr(HCrO_4)_2$ and Sr $(HCOO^-)_2$ might be very soluble in aqueous formic acid.

Example 18

This example evaluated the efficiency of various acids and/or other solvents in reducing Cr(VI) ions in the chromate primer coating. The acids were benzoic acid, ascorbic acid, acetic acid ($CH_3COOH$), and formic acid (HCOOH). The solvents were dimethylsulfoxide (DMSO), benzyl alcohol, and HPDI water. The same primer coated aluminum panels (coupon size) were used.

Procedure:

1. ~100 mg/ml benzoic acid in DMSO (benzoic acid/DMSO): Added 0.52 g benzoic acid to 5 ml DMSO.
2. ~100 mg/ml benzoic acid in BnOH (benzoic/DMSO): Added 0.5 g benzoic acid to 5 ml BnOH.
3. 0.3 M Ascorbic Acid in 50 v/v % Acetic Acid (ascorbic acid/50% acetic acid): Added 0.42 g ascorbic acid to 8 ml 50 v/v % acetic acid, and mixed for a few minutes. The resulting solution had a pH of-1.5.
4. 0.3 M Ascorbic Acid in 5 v/v/% Acetic Acid (ascorbic acid/5% acetic acid): Added 0.42 g ascorbic acid to 8 ml 5 v/v % acetic acid, and mixed for a few minutes. The resulting solution had a pH of ~2.
5. 0.3 M Ascorbic Acid in 5 v/v % Formic Acid (ascorbic acid/5% formic acid): Added 0.42 g ascorbic acid to 8 ml 5 v/v % formic acid, and mixed for a few minutes. The resulting solution had a pH of ~1.5.
6. Added each of the above five solutions to a container. Then, added each of the following solvent solutions to a container as a control: DMSO, BnOH, 50 v/v % acetic acid, 5 v/v % acetic acid, and 5 v/v % formic acid. Immersed one MIL-PRF-23377 primer coated aluminum panel (coupon size) in each of the ten solutions. Let the panels sit in the solutions overnight.

Observation:

1. DMSO: The leachate had a slight blue color. The primer coating was still yellow. No visible effect on the substrate.
2. Benzoic acid/DMSO: The leachate had a slight blue color. The primer coating was still yellow. No visible effect on the substrate.
3. BnOH: The leachate was colorless. No effect on the primer coating (the coating was still yellow and adherent). No effect on the substrate.
4. Benzoic acid/BnOH: The leachate was colorless. No effect on the primer coating (the coating was still yellow and adherent). No effect on the substrate.
5. 50% Acetic acid: The leachate's color changed to blue. The primer coating changed from yellow to brown. No effect on the substrate. This is similar to the observation for 50% HCOOH in Example 17. When the pH of the leachate was adjusted to be >7, the leachate did not change its color.
6. Ascorbic acid/50% acetic acid: The leachate's color changed to blue. The primer coating changed from yellow to a green-yellow color with substantial bubbling of the coating film. The substrate appeared to be unaffected. However, when the pH of the leachate was adjusted to be >7, the leachate changed its color from light blue to orange-brown and then to orange slowly.
7. 5% Acetic acid: The leachate was colorless. The primer coating changed from yellow to orange-brown. No effect on the substrate. When the pH of the leachate was adjusted to be >7, the leachate did not change its color.
8. Ascorbic acid/5% acetic acid: The leachate's color changed to light blue. The primer coating changed from yellow to green. No effect on the substrate. When the pH of the leachate was adjusted to be >7, the leachate changed its color to yellow-green and then to orange slowly.
9. 5% Formic acid: The leachate was colorless. The primer coating changed from yellow to brown. No visible effect on the substrate. When the pH of the leachate was adjusted to be >7, the leachate did not change its color.
10. Ascorbic acid/5% formic acid: The leachate's color changed to blue. The primer coating changed from yellow to green. No visible effect on the substrate. When the pH of the leachate was adjusted to be >7, the leachate changed its color to yellow and then to orange slowly.

Conclusion:

50% acetic acid by itself showed similar color changes to the leachate and to the primer coating as that of 50% formic acid in Example 17, indicating that 50% acetic acid alone might be able to extract $SrCrO_4$ from the coating and to reduce the extracted $SrCrO_4$. 5% acetic acid or 5% formic acid alone was shown to be able to change the color of the leachate and the primer coating to a lesser extent. Therefore, acetic acid and formic acid appeared to show some abilities to reduce Cr(VI) even at a low percentage of 5%.

The results also show that 50% acetic acid was compatible with ascorbic acid, and that the resulting combined 50% acetic acid/ascorbic acid solution might be able to extract $SrCrO_4$ from the intact primer coating and even possibly to reduce the extracted $SrCrO_4$ at the same time or shortly afterwards.

The addition of 5% acetic acid or 5% formic acid to the ascorbic acid showed similar compatibility with ascorbic acid. However, their abilities to extract and reduce SrCrO4 were shown to be less than that of 50% acetic acid and formic acid.

Finally, the other two solvents, DMSO and BnOH, did not show any effect on $SrCrO_4$ extraction from the intact primer, nor did they have a delaminating or swelling effect on the coating. Similarly, the combinations of benzoic acid/DMSO and benzoic acid/BnOH did not show any effect on $SrCrO_4$ extraction, nor did they show any indication of reducing Cr(VI) ions.

Example 19

This example tested various combinations of acid/ascorbate and evaluated their effectiveness at extracting/removing and reducing Cr(VI) from unaged, MIL-PRF-23377 primer-coated aluminum panels in coupon sizes.

The two acids, acetic and formic acid, were evaluated at concentrations of 50 wt %, 5 wt % and 0.5 wt %. The acids were expected to breakdown or digest the primer coating to allow the RR agent access to the Cr(VI) within the primer coating.

Procedure:

1. Prepared 12 samples according to the formulations listed in Table 10 below using this procedure:
   a. To each sample, added about 0.8 g sodium ascorbate (Sod. Ascorbate) to a test tube.
   b. To each test tube, then added appropriate amount of HPDI according to Table 10.
   c. Added an appropriate amount of the acid according to Table 10.

TABLE 10

Sample Formulations

| Sample # | Acid | % Acid | Sod. Ascorbate Conc. (M) | Amount of Sod. Ascorbate (g) | Vol of Acid to Add (mL) | Vol of HPDI to Add (mL) | Final Vol. (mL) |
|---|---|---|---|---|---|---|---|
| 1 | Formic | 50 | NA -- Control | 0.8 | 5 | 5 | 10 |
| 2 | Formic | 50 | 0.4 | | 5 | 5 | 10 |
| 3 | Formic | 5 | NA -- Control | 0.8 | 0.5 | 9.5 | 10 |
| 4 | Formic | 5 | 0.4 | | 0.5 | 9.5 | 10 |
| 5 | Formic | 0.5 | NA -- Control | 0.8 | 0.05 | 9.95 | 10 |
| 6 | Formic | 0.5 | 0.4 | | 0.05 | 9.95 | 10 |
| 7 | Acetic | 50 | NA -- Control | 0.8 | 5 | 5 | 10 |
| 8 | Acetic | 50 | 0.4 | | 5 | 5 | 10 |
| 9 | Acetic | 5 | NA -- Control | 0.8 | 0.5 | 9.5 | 10 |
| 10 | Acetic | 5 | 0.4 | | 0.5 | 9.5 | 10 |

TABLE 10-continued

Sample Formulations

| Sample # | Acid | % Acid | Sod. Ascorbate Conc. (M) | Amount of Sod. Ascorbate (g) | Vol of Acid to Add (mL) | Vol of HPDI to Add (mL) | Final Vol. (mL) |
|---|---|---|---|---|---|---|---|
| 11 | Acetic | 0.5 | NA -- Control | 0.8 | 0.05 | 9.95 | 10 |
| 12 | Acetic | 0.5 | 0.4 | | 0.05 | 9.95 | 10 |

2. Placed 12 unaged, primer-only coated aluminum panels into separate petri dishes.
3. Added each of the 12 solutions in Table 10 to one of the petri dishes, making sure that each panel was submerged in the solution.
4. Covered the petri dishes, and let the panels sit overnight in the solutions.
5. After overnight, drew off the liquid leachate from each petri dish, and transferred to separate vials using a pipette. Recorded the color of the leachate.
6. Rinsed the panel/dish twice with 2.5 ml of HPDI water for each rinse. Added the rinsates to the leachate in the previous step.
7. Analyzed the resulting leachate for chromate content by using the IC system and process in Example 2.
8. Recorded any changes to the primer coatings on the panels (e.g. color changes, delamination, bubbling). Dried the panels and petri dishes by dabbing them with a lint-free wipe.
9. Used a spatula to scrape the primer coating from the panel, and collected the scraped primer coating in the petri dishes.
10. Pulverized the scraped primer coating into a fine powder using the spatula. Analyzed the powdered primer coating for the Cr(VI) content using IC with the mod. OSHA ID-215 analytical method, the level of quantification being 0.0030 μg. The results from these exposure tests are provided in Table 11.
11.

TABLE 11

Test Results and Observations.

| Sample | pH | Cr(VI) Detected in Solid Post-Rxn (μg/mg) | Extraction Efficiency | Cr(VI) Conc. in Leachate (μg/mL) | Total Percent Cr(VI) Reduced | Primer Color Post-Rxn | Leachate Color Post-Rxn |
|---|---|---|---|---|---|---|---|
| 50% Formic Control | 0.5 | 83 | 99.8 | ND | 99.8 | brown | gray/blue |
| 50% Formic + RA* | 1 | 33 | 99.9 | ND | 99.9 | gray | blue |
| 5% Formic Control | 1.5 | 16000 | 64.4 | ND | 64.4 | dark brown | light yellow |
| 5% Formic + RA | 3 | 13000 | 71.1 | ND | 71.1 | light yellow | blue/green |
| 0.5% Formic Control | 2 | 38000 | 15.6 | ND | 15.6 | yellow/brown | clear |
| 0.5% Formic + RA | 5 | 36000 | 20.0 | ND | 20.0 | yellow | green |
| 50% Acetic Control | 1.5 | 9000 | 80.0 | ND | 80.0 | brown | pink |
| 50% Acetic + RA | 3 | 25000 | 44.4 | ND | 44.4 | brown | yellow/green |
| 5% Acetic Control | 2 | 34000 | 24.4 | ND | 24.4 | brown | clear |
| 5% Acetic + RA | 4 | 27000 | 40.0 | ND | 40.0 | light yellow | green |
| 0.5% Acetic Control | 3.5 | 47000 | −4.4 | ND | −4.4 | dark yellow | clear |
| 0.5% Acetic + RA | 5 | 43000 | 4.4 | ND | 4.4 | light yellow | light green |
| Primer PC | NA | 45000 | NA | NA | NA | NA | NA |

ND = Not Detected

*RA refers to 0.4M sodium ascorbate

Conclusion:

Table 11 shows that 50% formic acid was able to reduce 99.8% of Cr(VI) in the primer coating without sodium ascorbate and reduce 99.9% of Cr(VI) with sodium ascorbate after about 18 hours. 50% acetic acid was also able to reduce Cr(VI) in the primer coating, though to a much lesser extent. Therefore, formic acid is much more efficient at extracting Cr(VI) from the primer than acetic acid. Further, a higher concentration of any acid is much more efficient than that of any lower concentrations. In addition, it appears that the presence of ascorbate enhances the extraction efficiency of the acids.

IC analysis of the leachates shows no indication of Cr(VI) in any of the samples, including the control samples. Prior to the experiment, it was expected that the Cr(VI) would be detected in the control samples because there was no exposure to the RR agent, namely the sodium ascorbate. However, the results show that the Cr(VI) was reduced in the control samples by the formic or the acetic acid.

The kinetics of Cr(VI) reduction within the primer coating by formic and/or acetic acids are unknown and were not studied in the previous experiments. So a quick test was performed on the IC by spiking the leachate samples. The results show that formic and acetic acids did reduce Cr(VI), although much slower than sodium ascorbate.

For example, the leachate of the 50% formic acid control (contained no ascorbate) was spiked to 100 ppm Cr(VI), and was then injected on the instrument about 8 hours later. The Cr(VI) concentration was found to be reduced by 50%. However, when the leachate sample with 50% formic acid and ascorbate was spiked to 500 ppm Cr(VI), and was injected into the IC about 9 hours later, the IC results show no presence of Cr(VI), suggesting that all spiked Cr(VI) had been reduced.

Similar results were obtained for acetic acid except the spiking of acetic acid control showed only about 40% reduction of Cr(VI) after about 14 hours, which suggests that acetic acid reacts more slowly than does formic acid. The relative rates of Cr(VI) reduction within MIL-PRF-23377 primer coatings for all three compounds can be shown as follows:

Acetic Acid<Formic Acid<<<Ascorbate

Unexpectedly, the acid and the RR agent (ascorbate) were discovered to work in a synergistic fashion. The acid (formic or acetic), which was added to the formulation for the sole purpose of digesting the polyamide framework of the primer composition, can also work with the RR agent (ascorbate) to extract and even chemically reduce the Cr(VI) contained therein to some extent. At the same time, not only does the reducing agent (in this case ascorbate) chemically reduce the Cr(VI), it also improves the efficiency of the acid at extracting Cr(VI) from the primer. While not wishing to be bound by theory, it is presently believed that the ions in HCOOH, the acid dissociation $HCOO^-$ anion and $H^+$ ion, can penetrate and swell the primer thereby opening up fluid channels, through which the RR agent in the solvent (water and/or EDTA) enter and chemically reduce Cr(VI) to Cr(III) in the primer coating.

Example 20

This example evaluated the effect of the RR agent formulation and the addition of an organic solvent to the formulation on the topcoated aluminum panels (coupon size). The aluminum panels were 3 cm×3 cm aluminum panels coated with a MIL-PRF-23377 primer and urethane top coat. "%" refers to v/v %.

Procedure:

1. 50% Formic acid: Mixed 5 ml formic acid with 5 ml HPDI water.
2. 50% Formic acid/0.4 M sodium ascorbate: Weighed out 0.8 g sodium ascorbate, added 5 ml HPDI water, and then added 5 ml formic acid. Mixed for a few minutes.
3. 50% Formic acid/25% IPA/0.4 M sodium ascorbate: Weighed out 0.8 g sodium ascorbate, added 2.5 ml HPDI water, followed by the addition of 5 ml formic acid and 2.5 ml isopropanol (IPA). Mixed for a few minutes.
4. 50% formic acid/25% IPA: Mixed 2.5 ml HPDI water with 5 ml formic acid and 2.5 ml IPA.
5. 50% formic acid/25% acetone: Mixed 2.5 ml HPDI water with 5 ml formic acid and 2.5 ml acetone.
6. 50% formic acid/25% acetone/0.4 M sodium ascorbate: Weighed out 0.8 g sodium ascorbate, added 2.5 ml HPDI water, followed by the addition of 5 ml formic acid and 2.5 ml acetone.
7. Added ~7 ml of each of the six above solutions to each dish by using a transfer pipette. Put one coated aluminum panel in each dish, and let it sit in the solution overnight.

Observation:

1. The two solutions without any organic solvent (IPA or acetone) (solutions 1 and 2) produced a clear leachate with no observable color change. The coatings on the panels bubbled and disbonded but did not delaminate completely. Primer under the topcoat was light brown/yellow, indicating that the Cr(VI) in the primer coating was not fully reduced or extracted.
2. The two solutions containing IPA (solutions 3 and 4) produced light blue leachate solutions. The coatings were delaminated fully from the substrate. Rolling back the top coat revealed a grayish primer layer with no visible yellow color, showing that the RR agent was able to access the primer underneath and reduce/extract the Cr(VI) within the primer.
3. The two solutions containing acetone (solutions 5 and 6) produced a light blue leachate. The coatings were delaminated fully from the substrate. Rolling back the top coat revealed a grayish primer layer with no visible yellow color, showing that the RR agent was able to access the primer underneath and reduce/extract the Cr(VI) within the primer. Additionally, the primer was separated from the substrate and easily peeled away.

Conclusion:

The reducing solution containing 50% formic acid, 25% IPA or acetone, and 0.4 M ascorbate was able to, within 18 hrs, delaminate the top coat and reduce/extract (based on visual observations of color change) the Cr(VI) in the primer underneath. Additional benefits to this formulation are added viscosity (for the IPA formulation) and its ability to disbond the primer coating from the substrate at the same time, making the primer coating easier to remove.

Example 21

The example tested the reducing efficiency of the 50% formic acid and 0.4M sodium ascorbate solution on a Cr(VI) contaminated surface within a paint booth, including the metal walls and the ventilation filter materials. In the paint booth, the splashes of a MIL-PRF-23377 primer coating (contained Cr(VI)) were everywhere, including the wall and the filter.

Procedure:

The 50% formic acid and sodium ascorbate solution was prepared similar to the formulation for Sample #2 in Table 10 using the procedure listed in Example 19. The solution was placed in an aerosol spray bottle. Then, the solution was sprayed on the primer coating contaminated surface on the metal walls and the ventilation filter materials.

For the filter material, after spraying the solution on the yellow colored primer coating left on the filter, observations were then made at 80 minutes and 170 minutes intervals. Slight color change was observed at 80 minutes, and at 170 minutes, the color changed more substantially to purple greenish color.

For the metal wall #1, the solution was sprayed on the yellow primer coating portion of the wall, and then some visible color changes from yellow to blue-grayish were observed about 2 minutes after spraying the wall. After about 170 minutes, most of the yellow colors had changed to purple-blue.

For the wall #2, some visible color change from yellow to blue can be seen immediately after spraying the wall. After about 170 minutes, a majority portion of the yellow color changed to purple-blue.

CONCLUSION

Color changes after spraying the ascorbate/formic acid solution on the wall and on the filter show that the solution was efficient in reducing Cr(VI) within the primer coating accidently sprayed on the walls and filters of the paint booth.

While the forms of the invention herein disclosed constitute presently preferred embodiments, many others are possible. It is not intended herein to mention all of the possible equivalent forms or ramifications of the invention. It is to be understood that the terms used herein are merely descriptive, rather than limiting, and that various changes may be made without departing from the spirit of the scope of the invention.

The invention claimed is:

1. A formulation for reducing Cr(VI) within a Cr(VI) containing coating that is bonded to a substrate, comprising:

a. at least one reducing chemical capable of reducing Cr(VI) to Cr(III), selected from a group consisting of ferrous salts, hydroxylamines and like, ascorbic acid, ascorbate, sorbate, sorbic acid, acetic acid, propionic acid, butylated hydroxytoluene, butylated hydroxyanisole, tert-butylhydroquinone, propyl gallate, glycolic acid (or hydroxyacetic acid) and other a-hydroxy acids (AHA), formic acid, other similar acids, and a mixture; and b. one or more solvents that are capable of helping the reducing chemical penetrate into the coating to reduce Cr(VI) within the coating; wherein the combined action of the reducing chemical and the solvent is able to penetrate into the coating to reduce Cr(VI) within the coating.

2. The formulation of claim 1, wherein the solvent is aqueous or a combination of aqueous and organic.

3. The formulation of claim 1, wherein the solvent is organic, comprising toluene, acetone, ethanol, diglyme, isopropyl alcohol, methyl ethyl ketone (MEK), methyl isopropyl ketone, glycol ether, methyl isobutyl ketone (MIBK), Graf Off® cleaner, GOOP® cleaner, GO-JO® cleaner, other similar degreasers or degreasing agents, paint stripper or remover, such as dichloromethane, Perc (perchloroethylene), Trichlor (TCE, trichloroethylene), turpentine, linseed oil, propylene glycol, tripropylene glycol methyl ether, D-limonene, limonene, citrus extracts, N-methyl pyrrolidone (NMP), alkyl esters of succinic, adipic, and/or glutaric acids, aromatic hydrocarbons, dimethylformamide, dimethyl sulfone (DMSO), propylene carbonate, chloroform, carbon tetrachloride, ethyl acetate, isopropanol, skin-penetrating hand creams and ointments, or a mixture thereof.

4. The formulation of claim 1, further comprising one or more chelating agents.

5. The formulation of claim 1, further comprising one or more emulsifier agents, pH adjusting agents, activators, surfactants, viscosity modifiers, gelling agents, or mixtures thereof.

6. A Cr(VI) reduction kit comprising a. a Cr(VI) reducing formulation of claim 1; and b. at least one color reference tool for evaluating the process and/or completion of the Cr(VI) reduction.

7. The kit of claim 6, wherein the color reference tool comprises one or more colors, in which at least one color indicates the completion of the chromate reduction.

8. The kit of claim 6, wherein the formulation is able to reduce Cr(VI) within the coating at ambient or room temperature.

9. A formulation to reduce Cr(VI) within a coating that is bonded to a substrate, comprising:

a. at least one reducing chemical capable of reducing Cr(VI) to Cr(III), selected from a group consisting of ferrous salts, hydroxylamines and like, ascorbate, sorbate, butylated hydroxytoluene, butylated hydroxyanisole, tert-butylhydroquinone, propyl gallate, and a mixture thereof; and b. one or more organic compounds selected from a group consisting of acetic acid, formic acid, ascorbic acid, sorbic acid, propionic acid, glycolic acid or hydroxyacetic acid, other a-hydroxy acid, and a mixture thereof;

wherein the combined action of the reducing chemical and the organic compound is able to penetrate into the coating to reduce Cr(VI) within the coating.

10. The formulation of claim 9, wherein the formulation is able to reduce Cr(VI) within the coating at ambient or room temperature.

11. The formulation of claim 9, further comprising one or more organic solvents that are capable of helping the reducing chemical and the organic compound penetrate into the coating.

12. The formulation of claim 11, wherein the organic solvent comprises isopropyl alcohol, acetone, methyl isobutyl ketone, methyl ethyl ketone, benzyl alcohol, n-methyl pyrrolidone, or a mixture thereof.

13. The formulation of claim 9, further comprising one or more chelating agents.

* * * * *